US011205412B1

(12) United States Patent
Lu et al.

(10) Patent No.: US 11,205,412 B1
(45) Date of Patent: Dec. 21, 2021

(54) HYBRID ACTIVE NOISE CANCELLATION FILTER ADAPTATION

(71) Applicant: SHENZHEN GOODIX TECHNOLOGY CO., LTD., Shenzhen (CN)

(72) Inventors: Youhong Lu, San Diego, CA (US); Ching-Hua Yeh, San Diego, CA (US)

(73) Assignee: SHENZHEN GOODIX TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 17/180,844

(22) Filed: Feb. 21, 2021

Related U.S. Application Data

(63) Continuation of application No. 16/888,830, filed on May 31, 2020, now Pat. No. 10,950,213.

(51) Int. Cl.
*G10K 11/178* (2006.01)
*H04R 1/10* (2006.01)

(52) U.S. Cl.
CPC .. *G10K 11/17817* (2018.01); *G10K 11/17881* (2018.01); *H04R 1/1083* (2013.01); *G10K 2210/1082* (2013.01); *G10K 2210/3026* (2013.01); *G10K 2210/3028* (2013.01); *H04R 2460/01* (2013.01)

(58) Field of Classification Search
CPC ..... G10K 11/175; G10K 11/17817; G10K 11/17881; G10K 2210/3028; G10K 2210/3031; G10K 2210/3026; G10K 2210/1082; H04R 1/1083; H04R 2460/01
USPC ..... 381/71.11, 71.2, 71.1, 73.1, 94.1
See application file for complete search history.

(56) References Cited

U.S. PATENT DOCUMENTS

| | | | | |
|---|---|---|---|---|
| 6,694,018 | B1 * | 2/2004 | Omori | H04M 9/082 379/388.02 |
| 8,401,205 | B2 * | 3/2013 | Itabashi | G10K 11/17875 381/71.6 |
| 9,659,558 | B2 * | 5/2017 | Park | G10K 11/002 |
| 2005/0175187 | A1 * | 8/2005 | Wright | G10K 11/17854 381/71.12 |
| 2008/0112570 | A1 * | 5/2008 | Asada | G10K 11/17854 381/71.6 |
| 2010/0310086 | A1 * | 12/2010 | Magrath | G10K 11/17873 381/71.11 |
| 2018/0261199 | A1 * | 9/2018 | Kumar | G10K 11/17827 |

* cited by examiner

*Primary Examiner* — Ahmad F. Matar
*Assistant Examiner* — Sabrina Diaz
(74) *Attorney, Agent, or Firm* — Kilpatrick Townsend & Stockton LLP

(57) ABSTRACT

An apparatus includes a hybrid adaptive active noise control unit (HAANCU) configured to provide an anti-noise signal to an ear speaker from a reference noise signal of a reference microphone and an error signal of an error microphone, a decimator configured to decimate the reference noise signal and error signal, an adaptive hybrid ANC training unit (AHANCTU) including at least one noise cancellation filter and a filter configured to provide a feedback signal to the at least one noise cancellation, which trains parameters of the AHANCTU based on the decimated reference noise signal, the decimated error signal, and the feedback signal. The apparatus further includes a rate conversion unit configured to up-sample the parameters and update the HAANCU with the up-sampled parameters.

20 Claims, 25 Drawing Sheets

400

500

900

1100

2000

2100

HYBRID ACTIVE NOISE CANCELLATION FILTER ADAPTATION

RELATED INVENTION

This application is a continuation of U.S. patent application Ser. No. 16/888,830, for "HYBRID ACTIVE NOISE CANCELLATION FILTER ADAPTATION" filed on May 31, 2020, which is hereby incorporated by reference in its entirety.

BACKGROUND OF THE INVENTION

Active noise cancellation (ANC) is to cancel noise in an area or at a location by generating a synthesized noise through an audio transducer (for example, a loudspeaker located in that area or at that location) such that the generated signal ideally has the same magnitude as that of the noise but with inverted polarity. An error sensor is also placed in that area to pick up the mix of the noise and the generated (played) synthesized noise, the result of the mix of the noise and the generated (played) synthesized noise is referred to as an error signal. ANC algorithms may be used in ANC filter designs to minimize the error signal. An error sensor can be integrated with a device (e.g., an ear speaker), such that ANC can be updated in real-time. Alternatively, the error sensor may not be used with a device. In this case, a fixed ANC is fitted offline.

The synthesized noise after passing through an acoustic path, referred to as a secondary path, must be as closer as possible to the noise with inverted polarity. In this way, the error signal, which is the mix of the noise and the synthesized noise, received from the error sensor is minimized or eliminated. In order to achieve the objective, the secondary path cannot delay the synthesized noise significantly because noise is varying. The synthesized noise therefore must arrive to the noise area or at the location with little delay. This requires that the secondary path delay be very short.

In order to synthesize noise, a reference noise needs be captured via a reference sensor or other means. The reference noise can be an earlier version of the noise with additional reflections of the noise via multi-paths. The synthesis of the noise can be done by applying an adaptive filter or a controller to the reference noise such that the error (difference) between the noise and the played synthesized noise is minimized. The noise synthesis must be done quickly so that it adds little delay such that the synthesized noise arrives to the noise area on time. This ANC is called feedforward ANC. Since there is a reference sensor to sense the earlier version of the noise, feedforward ANC can cancel relatively wideband noise. Therefore, the feedforward ANC is referred to as the wideband (WB) ANC throughout the present disclosure.

If a noise is narrowband noise or includes several tonal signals, a synthesized noise can be predicted from the narrowband noise. Thus, ANC uses an error signal from an error sensor to estimate the noise from it and predicts the noise from the estimation. This type of ANC is referred to as feedback ANC in which the reference sensor is not needed. The prediction performance is higher with lower waterbed effect (undesired noise with a relatively narrow frequency band) if the secondary path and processing have low latency. Thus, for certain bandwidths, the feedback ANC has better performance with lower latency. If a signal is not narrowband, the narrowband requirement can be achieved by emphasizing some frequency bands where noise reduction is desired. It is referred to as narrowband (NB) ANC.

In order to cancel both wideband (WB) and narrowband (NB) noises, WB and NB ANCs can be mixed to form a mixed ANC, which is referred to as hybrid ANC. There are several ways to implement hybrid ANCs. For example, a WB ANC can be first optimized followed with optimizing an NB ANC independently, or vice versa. Alternatively, the WB ANC and NB ANC can be jointly optimized.

ANC can be realized with analog circuits. For lightweight devices, active resistor and capacitor (RC) circuits are very effective for analog ANC designs. It is however difficult to change the RC circuit parameters in real-time to adapt to varying environments. In addition, the device acoustics may be different from one device to another device even if they are of the same type. This requires using different component values in the RC circuits for each device, which requires considerable design effort and presents an insurmountable obstacle in mass production.

Digital designs are more flexible than analog designs because processing with modern algorithms can be realized easily with a digital component, such as a digital signal processor (DSP) or the like. Therefore, ANC has been realized with digital circuits. Filtered LMS algorithms with FTR filters are widely used in ANC designs.

A hybrid ANC generally uses a feedback filter to predict the noise for canceling low frequency and/or tonal-like noise and uses a feedforward filter to synthesize anti-noise from a reference noise for canceling broadband or wideband noise. Both analog and digital circuits are used. Low speech digital circuits with advanced algorithms have been successfully used for ANC designs in many years. But the noise cancellation performance is limited due to high latency in the playback synthesized noise path.

In recent years, fast digital processing circuits are used in which most processing is fixed while little coefficients are updated in real-time. The performance is improved but still limited because full and complex algorithms cannot be used due to high computational cost and power consumption.

BRIEF SUMMARY OF THE INVENTION

The present invention relates to active noise cancellation or control, and particularly, to an apparatus, system, and method for cancelling noise utilizing low latency digital signal processing techniques. The present invention has been implemented in view of the foregoing problems and provides thus technical solution that has low computational cost, power consumption and low latency in the playback synthesized noise path. One such active noise cancellation apparatus includes a reference microphone, an error microphone, and hybrid noise cancellation circuitry having a wideband noise cancellation filter of a first bandwidth, a narrowband noise cancellation filter of a second bandwidth smaller than the first bandwidth, and a feedback filter having an impulse response which represents an acoustic path between an ear speaker and the error microphone, and some associated sensor drive circuits.

According to a first aspect, the inventive concept is directed to an apparatus for hybrid active noise control filter adaption. The apparatus includes a hybrid adaptive active noise control unit (HAANCU) configured to generate an anti-noise signal from a first reference noise signal received from a reference microphone and a first error signal received from an error microphone, a decimator configured to decimate the first reference noise signal and the first error signal to a second reference noise signal and a second error signal, respectively, an adaptive hybrid ANC training unit (AH-ANCTU) coupled to the decimator and including at least one noise cancellation filter and a feedback filter configured to provide a feedback signal to the at least one noise cancellation filter to train parameters of the at least one noise cancellation filter together with second reference noise signal and the second error signal, a filter rate conversion circuit configured to up-sample the parameters and update the HAANCU with the up-sampled parameters.

According to another aspect, the inventive concept is directed to a method for adaptively training a hybrid active noise cancellation apparatus, which includes a hybrid adaptive active noise control unit (HAANCU) configured to receive a first reference signal and a first error signal and provide an anti-noise signal to an ear speaker for cancelling the first reference noise signal, an adaptive hybrid active noise cancellation training unit (AHANCTU) comprising at least one noise cancellation filter and a feedback filter configured to provide a feedback signal to the at least one noise cancellation filter. The method includes receiving the first reference noise signal by a reference microphone and the first error signal by an error microphone by the HAANCU, decimating the first reference noise signal and the first error signal to obtain a second reference noise signal and a second error signal. The method further includes training parameters of the at least one noise cancellation filter based on the second reference noise signal, the second error signal, and the feedback signal, up-sampling the trained parameters of the at least one noise cancellation filter to obtain up-sampled parameters by a rate conversion unit, and updating the HAANCU with the up-sampled parameters.

Embodiments provide an apparatus, system, and method for actively cancelling noise. The apparatus includes three main components, such as a hybrid adaptive active noise control (ANC) unit, an adaptive hybrid ANC training unit, and a rate conversion unit disposed between the hybrid adaptive ANC unit and the adaptive hybrid ANC training unit. The hybrid ANC unit operates at high sampling rates, the adaptive hybrid ANC training unit operates at low sampling rates, and the rate conversion unit converts filter coefficients of the wideband ANC unit and in the narrowband ANC unit that have been trained in the adaptive hybrid ANC training unit from a low sampling-rate range to a higher sampling-rate range of the hybrid adaptive ANC unit. These and other embodiments of the present invention along many of its advantages and features are described in more detail in conjunction with the text below and attached figures.

BRIEF DESCRIPTION OF THE DRAWINGS

The benefits and advantages of the invention concept will be apparent from the detailed description of embodiments of the present disclosure and the accompanying drawings in which like reference characters and numerals refer to the same parts throughout the figures. The drawings are not to scale, emphasis is placed upon illustrating the principles of the inventive concept.

DETAILED DESCRIPTION OF THE INVENTION

Figure 1A:
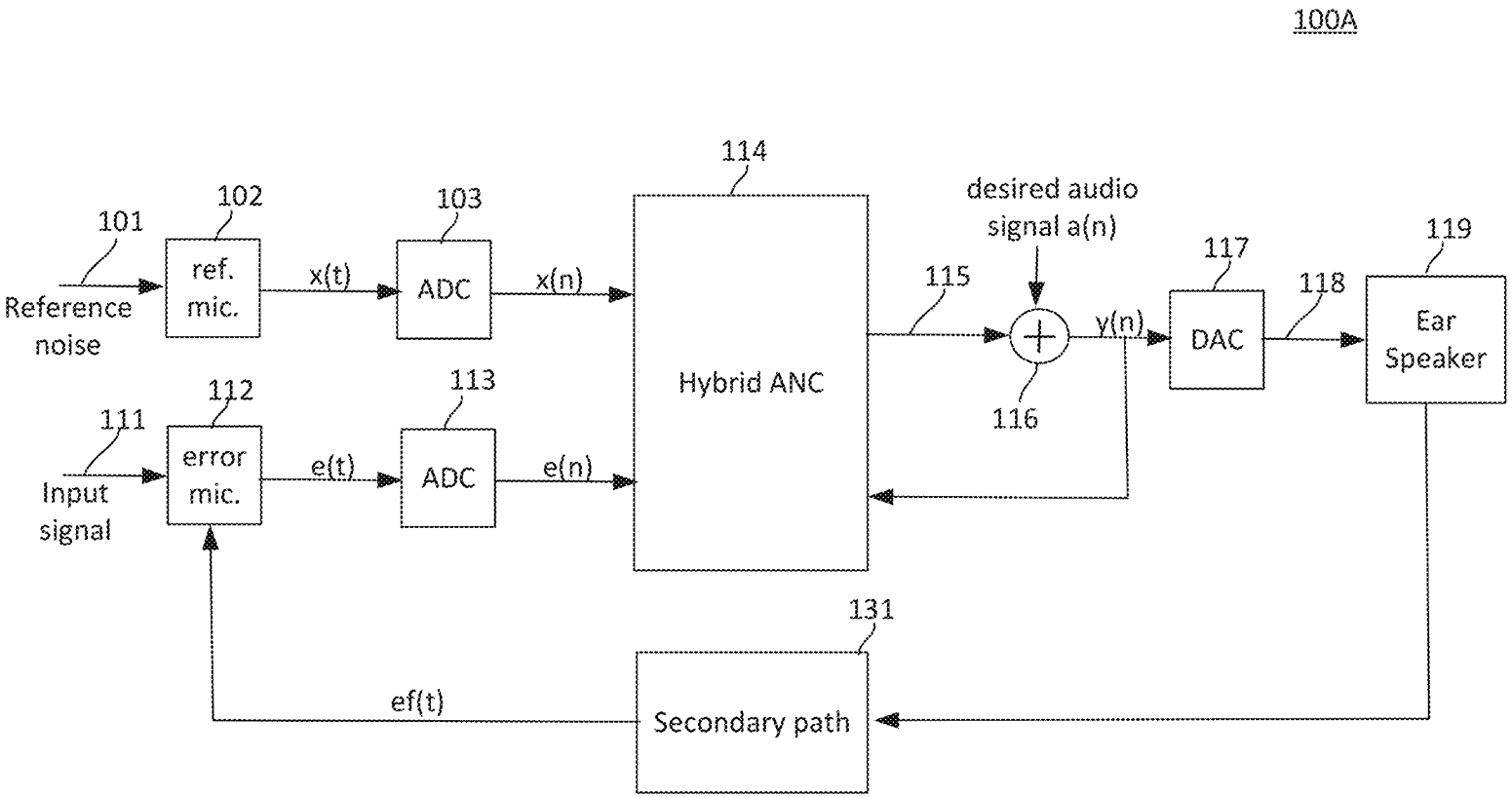
FIG. 1A is a simplified block diagram of an adaptive hybrid active noise cancellation (ANC) system according to an embodiment of the present disclosure.

Embodiments of the present disclosure provide adaptive noise cancellation techniques, apparatus, and methods that can be implemented in a variety of personal audio devices, such as a mobile telephone, headset, audio player, and the like. A personal audio device includes a hybrid adaptive active noise control unit that receives reference noise (ambient noise) and generate an anti-noise signal to cancel the reference noise. A reference microphone may be provided to receive the reference noise, an error microphone may be provided to receive an error signal from an ear speaker, and a filter representing an acoustic path between the ear speaker and the error microphone may be provided to adaptively control the anti-noise signal to cancel the reference noise.

In some embodiments, the hybrid adaptive active noise control unit may include active noise cancellation filters and a rate conversion unit, where the active noise cancellation filters can be updated in real time with low power computational techniques. In some embodiments, the active noise cancellation filters may have a set of filter coefficients that can be trained at very low sampling rates and memory usage. The trained set of filter coefficients are then up-sampled to higher sampling rates with selected poles and zeroes and gains closer to the frequency responses of the active noise cancellation filters at low sampling rates. The novel technical solutions thus alleviate the problems of high latency, high power consumption, and high computational costs associated with sampling rate conversion techniques that utilize pulse-density modulation and sigma-delta modulation and real-time filter adaption techniques that compromise filter stability in active noise cancellation seen in conventional implementations.

Many theoretical studies of digital ANC are known. However, their performance is limited due to the following factors: 1) high latency due to the secondary path and processing delays, 2) high processing and hardware power consumption, and 3) high hardware cost for lightweight devices.

In the earlier ANC, the signals from both reference sensor and error sensor are sampled with a lower sampling rate (16 ksamples/s or 8 ksamples/s, for example) to reduce power consumption and hardware cost. A digital signal processing (DSP) device receives these signals and processing them and synthesizes a signal to play back to the noise area. Because the sampling rate is low, processing power requirements are small and FIR filters can be used as adaptive filters or ANC controller.

Although the earlier digital ANC works, it has limited performance due to a longer secondary path and processing latency so that a synthesized noise cannot arrive timely to the noise area. Low sampling rates will increase latency because group delays due to ADC and DAC depend on a certain number of samples. The delay of each sample in low sampling rates is also large. In addition, DSP adds latency of several samples due to processing and buffering delays.

Current digital devices can operate at a very high sampling rate. For example, sampling rates higher than or equal to 768 ksamples/second are seen in ANC products in recent years. The secondary path latency is low in this case. In order to reduce the power consumption and hardware cost, there is little real-time ANC processing done in the device. IIR filters are used in almost all ANC devices in recent years because the number of taps in IIR filters are very small resulting in small processing requirements.

Many digital ANC devices use IIR filters as ANC filters and controllers. The frequency response of the main path and secondary path are measured offline. Coefficients of ANC filters and controllers are generated through fitting algorithms offline and then written into ANC registers for real-time ANC processing. Taking a headset on a man-made head as an example, reference microphone and error microphone are connected to a recording device to record frequency response of the microphones while playing sweep tones outside of the headset. Using various combination of recordings, ANC filter coefficients can be computed via a personal computer (PC) or other computing devices.

The ANC coefficients in this case are fixed in a device. The requirements to the processing are low so that hardware cost and power consumption are very low. The performance of ANC may be good if the main path and the secondary path do not change in an ANC device. In practice, device acoustics vary from one device to another. Even with the same device, the acoustics performance may vary with environments and user's head. Therefore, such ANC may be relatively robust for well-designed devices, such as some professional headsets. It is difficult to achieve good performance for ear speakers with relaxed acoustic design requirements.

In order to improve ANC performance with varying acoustics, the proposal to perform ANC with high-speed hardware while ANC coefficients are trained in real-time in low-speed hardware has been seen recently. However, the approach has the following drawbacks: (1) converting ANC filters from low-speed pulse-code modulation (PCM) domain to high-speed pulse-density modulation (PDM) domain is realized with hardware similar to a sigma-delta modulation, which may add delay due to operation of PCM to PDM so that the advantage of the high-speed operation and low-filter order may be lost; (2) most operations of low-speed ANC filter adaptation follow existing digital adaptive ANC with emphasis on adaptation control to components of filters mostly for stability, which may not be efficient; and (3) there are practically no ANC designs based on ANC performance specifications.

The present inventors found that: (1) there is a need to address an advanced hybrid ANC in which full and complex adaptive algorithms can be used to update adaptive filters and controllers in real-time; (2) there is a need to address the advanced hybrid ANC such that ANC performance is higher with all kinds of environments and/or devices; (3) there is a need to address an ANC such that a designed ANC has desired performance specified by a user according to the user's device and user experience; (4) there is a need to do ANC filter adaptation in an efficient way; and (5) there is a need to have efficient converter of ANC filters from low-sampling rates to high-sampling rates such that the filter's orders are in the similar range, its frequency response is the same in the frequency bands of interest, and minimal or zero in other frequency bands. Other needs in accordance with the present disclosure are also contemplated.

The present inventors thus proposed novel hybrid ANC solutions to address the full and complex adaptive algorithms with efficient implementation in real-time. The beneficial features include mapping of ANC filter coefficients from a low-frequency range to a high-frequency range, and incorporating user's performance specifications in the design of ANC. The obtained performance is higher with all kinds of environment because the adaptation of all filter coefficients occurs in real-time. Other advantages in accordance with the present disclosure are also contemplated.

I. Novel Adaptive ANC Systems

FIG. 1A is a simplified block diagram illustrating an adaptive hybrid active noise cancellation (ANC) system 100A according to an embodiment of the present disclosure. The adaptive hybrid ANC system 100A may be an earpiece that includes a reference microphone 102 for picking up a reference noise 101 in a given area or at a given location and generating an electrical signal x(t), and a first analog-to-digital converter (ADC) 103 for sampling the electrical signal x(t) and generating a sampled signal x(n). The adaptive hybrid ANC system 100A also includes an error microphone 112 for picking up an input signal 111 (which may include an audio signal, a noise signal from ambient noise, and/or residual noise signal in the earpiece) and generating an electrical signal e(t), and a second ADC 113 for sampling the electrical signal e(t) and generating a sampled signal e(n). Sampled signals x(n) and e(n) are provided to a hybrid ANC circuit or hybrid ANC unit 114 to obtain an anti-noise signal 115 that is added to a desired audio signal a(n) by an adder 116 to cancel or reduce the reference noise. The noise reduced audio signal y(n) is provided to a digital-to-analog converter (DAC) 117, which outputs an analog audio signal 118 to an ear speaker 119 that produces sounds to a user. The terms unit, device, and circuit may be interchangeable used and refers to circuitry or software program performing one or more particular functions. The adaptive hybrid ANC system 100A further includes an acoustic feedback path (secondary path) 131 between the ear speaker 119 and the error microphone 112 including the ADC 113 and DAC 117. In an alternative embodiment, the error microphone 112 may only pick up a feedback noise signal ef(t) from the ear speaker 119 so that the input signal 111 is not present. Although two ADCs (103, 113) are shown, it is understood that the analog-to-digital conversion operations for the reference noise x(t) and electrical signal e(t) can be performed by a single ADC device. As used herein, the term "adder" refers to a circuit, an arithmetic logic unit, digital logic or software program that combine two or more signals by arithmetic addition and/or subtraction. The adder, alternatively referred to as a logic unit, may include two or more inputs for receiving digital (e.g., binary) values and outputting digital data (e.g., a number of bits) as a result. The ear piece, ear speaker, ear phone, earpiece, speaker, earphone may be interchangeably used and refer to an electro-acoustic transducer that convert electrical signals to sound. The desired audio signal may be a digital recording, streaming or broadcasting of a piece of music or sound that a user wants to listen to.

Other adaptive hybrid ANC systems are also possible. For example, for cost and fidelity reasons, a fully digital audio system may include a digital audio source (i.e., a digital microphone having a built-in analog-to-digital converter), digital hybrid ANC circuitry, and a digital audio amplifier, which drives the speaker. Of course, other alternative systems utilizing ANC embodiments of the present invention are apparent to those skilled in the art having reference to this disclosure. As used herein, the terms "wideband noise cancellation filter," "wideband active noise cancellation filer," "wideband active noise control filter," and "wideband ANC filter" are interchangeably used. Similarly, the terms "narrowband noise cancellation filter," "narrowband active noise cancellation filer," "narrowband active noise control filter," and "narrowband ANC filter" are interchangeably used.

Figure 1B:
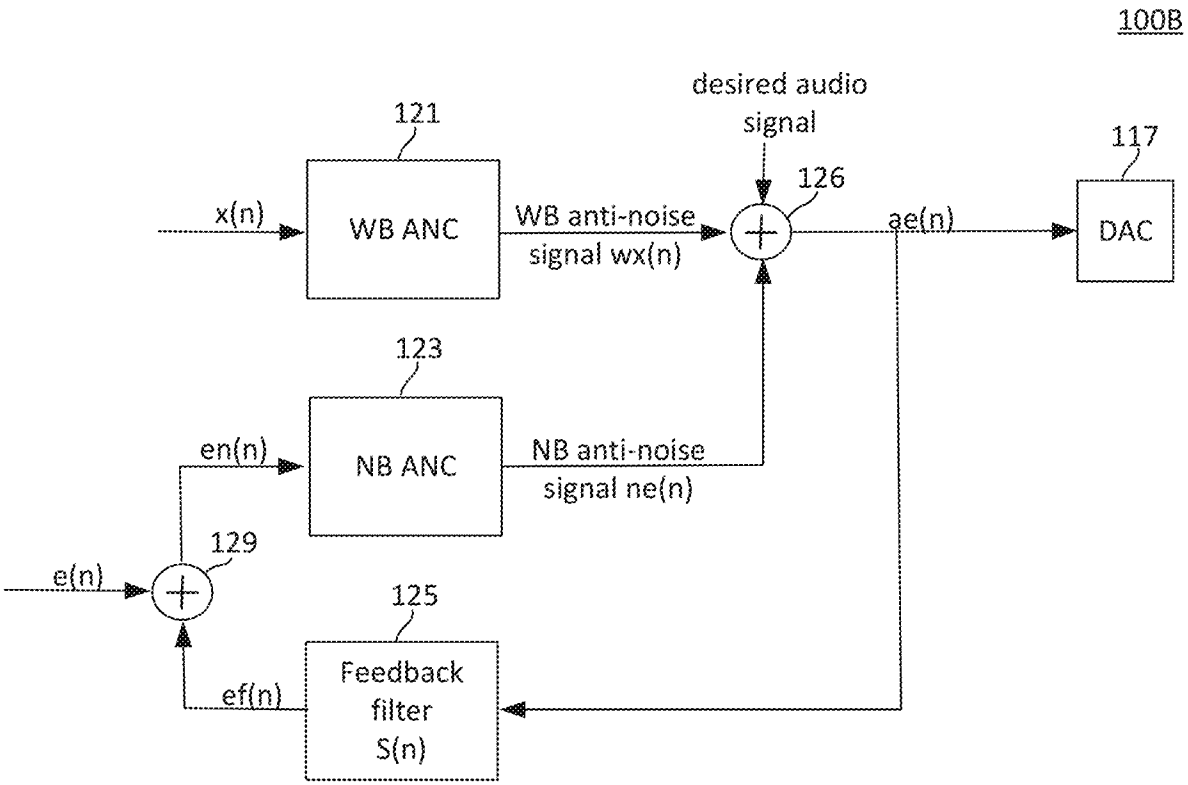
FIG. 1B is a simplified block diagram of the hybrid ANC of FIG. 1A.

FIG. 1B is a simplified block diagram illustrating an embodiment of adaptive hybrid ANC system 100B of FIG. 1A. The adaptive hybrid ANC system 100B is shown as including a wideband ANC filter 121 configured to receive the sampled reference signal x(n) and output a wideband anti-noise signal wx(n), and a narrowband ANC filter 123 configured to receive an error noise signal en(n) which is a mix of the sampled signal e(n) and a feedback noise signal ef(n) and output a narrowband error signal ne(n), which is NB anti-noise to be played out around the error microphone. The adaptive hybrid ANC 100B also includes a feedback filter 125 having an impulse response S(n) representing the acoustic path (secondary path) between the digital audio signal ae(n) (before the DAC 117) and the sampled signal e(n) (after the second ADC 113 of the error microphone 112). The feedback filter 125 is configured to receive an audio signal ae(n), which may include a residual error signal and provide a filtered signal, which is the feedback noise signal ef(n) at its output.

In accordance with the present invention, the full and complex adaptive algorithms can be used to update coefficients of adaptive filters in real-time with an efficient implementation. The ANC performance is higher in various types of environmental noise because the adaptation is in real-time for all coefficients. The proposed ANC filter can achieve the desired performance according to user experience and user's specifications. The conversion of ANC filters from a low-sampling rate to a high-sampling rate is performed via DSP or similar hardware.

The proposed hybrid ANC is based on an adaptive filtering architecture with different adaptive filter design algorithms. Thus, the foundation is based on the adaptive filtering theory. The proposed hybrid ANC can be based on a control architecture with different controller design algorithms, in which the control theory can serve as its design foundation.

Figure 1C:
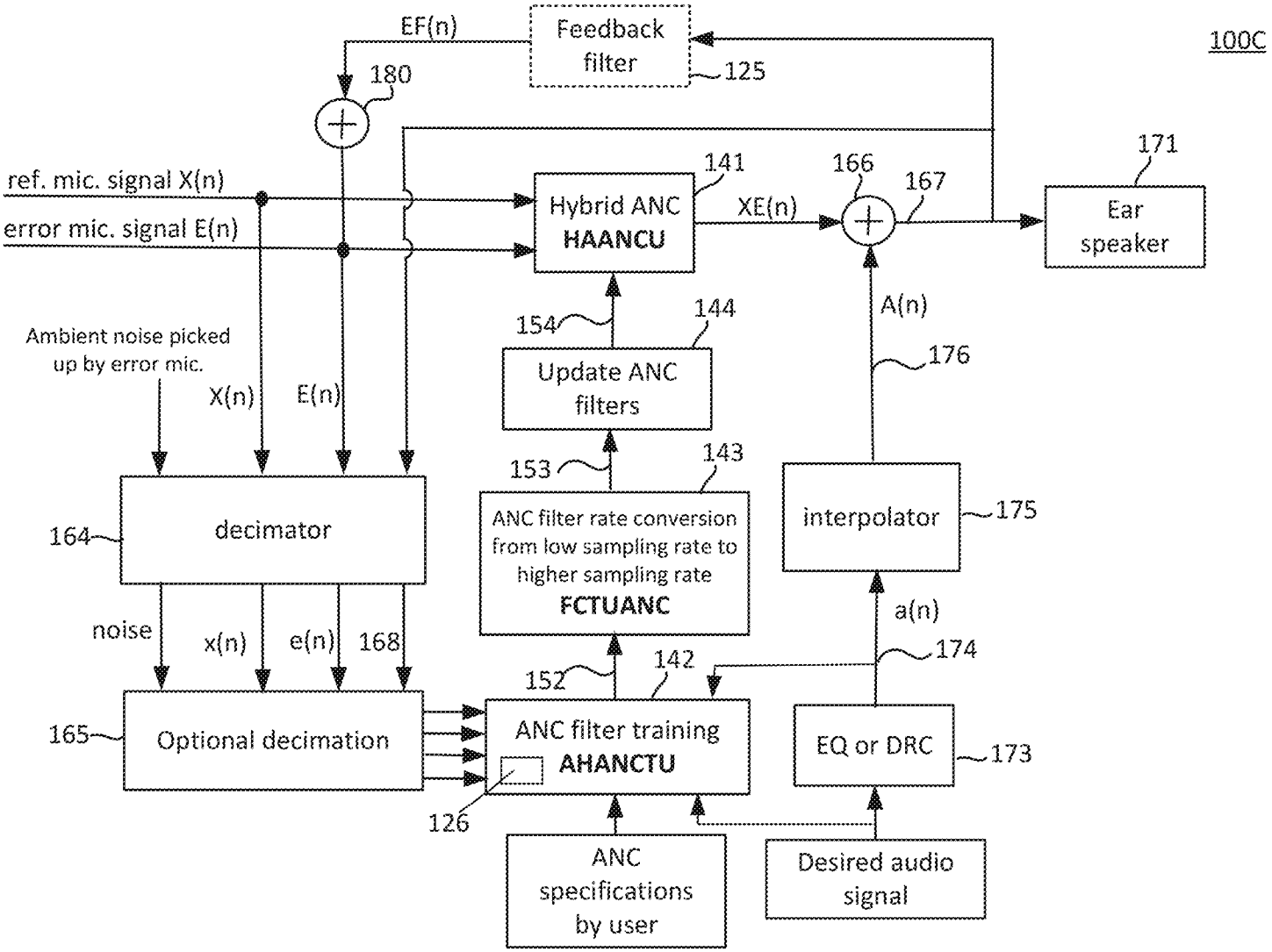
FIG. 1C is a simplified block diagram of an adaptive hybrid ANC system according to an embodiment of the present disclosure.

FIG. 1C is a block diagram of an adaptive hybrid ANC system 100C according to some embodiments of the present invention. The reference microphone, the error microphone, the ADCs, the DAC and the speaker in FIG. 1C are not shown herein for clarity reasons.

Referring to FIG. 1C, the proposed adaptive hybrid ANC system 100C includes three main components:

(1) Hybrid adaptive ANC unit (HAANCU) 141 operating at high speed, e.g., at a sampling rate greater than several times the Nyquist rate of down-sampled signals in low-speed unit 142, and mainly performing filtering operations to achieve noise reduction. HAANCU 141 can comprise one or more filters, and an ANC filters update unit 144 continuously updates adaptive coefficient(s) of the one or more filters in HAANCU 141 in real-time.

(2) Adaptive hybrid ANC training unit (AHANCTU) 142 operating at a lower speed (e.g., a sampling rate lower than 10 times the Nyquist rate). AHANCTU 142 can comprise one or more hybrid ANC filters with coefficients in lower selected frequency ranges. AHANCTU 142 can obtain the coefficients of the hybrid ANC filters via a combination of algorithms, external specifications, and equalizers. The obtained coefficients can be outputted to a rate conversion unit 143.

(3) a rate conversion unit (FCUANC) 143 configured to convert coefficients of adaptive filters from a low-frequency range to a higher-frequency range. The rate converted coefficients are used in HAANCU 141. It is important that frequency responses of input and output filters are substantially the same in the frequency range that an ANC cancels the noise. Interpolation methods with delay are not recommended and would not work well with various embodiments.

As used herein, the term "unit" refers to a device, which includes at least one programmable hardware element, a logic circuit, or a combination of hardware logic and software program. A unit may include a processing device for executing software to perform the filter training, filter rate conversion and adaptive noise control functions. A unit may include interface logic and software program that, for example, enable a user to enter the active noise cancellation specifications (denoted as "ANC specifications") to the ANC system, select and update the ANC algorithms according to application requirements, and/or modify the adaptive hybrid ANC architectures. The term "device" refers to a unit including a combination of hardware and software that can perform noise cancellation operations or functions. The device or unit may include adaptive finite impulse response (FIR) filters, infinite impulse response (IIR) filters, analog-to-digital converters (ADC), digital-to-analog converter (DAC), and sampling rate converters. The term "real-time" refers to cause and effect that occur without noticeable time lag or without significant time delay between the cause and effect but not necessary at the same time.

The adaptive hybrid ANC system 100C further includes a decimator 164 which down-samples the reference noise signal X(n) by the ADC 103 to a down-sampled reference signal x(n) and the input signal E(n) by the ADC 113 to a down-sampled error signal e(n). In an example embodiment, the decimator 164 may have a decimation factor of 16. For example, when the ADC 103 and ADC 113 have a sampling rate of 768 ksamples/s, the decimator 164 will reduce the signals to a sampling rate of 48 ksamples/s. In one embodiment, the adaptive hybrid ANC system 100C may also include a second decimator 165 which may further reduce the sampling rate of 48 ksamples/s to 16 ksamples/s. In one embodiment, the decimators 164 and 165 can be combined. The down-sampled signals are provided to the ANC filter training unit (AHANCTU) 142 for obtaining filter coefficients 152 for the hybrid adaptive ANC unit (HAANCU) 141 via an ANC filter conversion unit 143 and an update ANC filter unit 144. The thus obtained filter coefficients 152 are converted to filter coefficients 153 at a higher sampling rate by the ANC filter conversion unit 143 for updating the filters coefficient 154 in the hybrid adaptive ANC unit (HAANCU) 141 by the update ANC filters unit 144. The filter output from the ANC filter rate conversion unit 143 is required to have substantially the same frequency response in the frequency range of noise-canceling and its amplitude frequency response above the noise-canceling frequency range is small for preventing amplification of noise. The hybrid adaptive ANC unit (HAANCU) 141 outputs an anti-noise signal XE(n), which is mixed with an audio signal A(n) 176 by an adder 166 to provide a noise-reduced audio signal 167 to an audio transducer 171 (e.g., an ear speaker).

The adaptive hybrid ANC system 100C further includes a feedback filter 125 between the ear speaker 171 and the error microphone and configured to provide an EF(n) signal that is a mix signal 167 of the anti-noise signal and the audio signal. In accordance with the present invention, the characteristic of the feedback filter 125 is critical to be modeled as accurate as possible in the frequency range of interest to obtain the optimal performance of the HAANCU 141, in particular the performance of the narrowband (NB) ANC filter 123. In one embodiment, the mix signal 167 is down-sampled by the decimator 164 (and optional decimator 165) and provided as a down-sampled signal 168 to the AHANCTU 142. In this case, the feedback filter (denoted as block 126) is located in the AHANCTU 142 and operates at low sampling rates as those of the reference signal x(n) and error signal e(n). In one embodiment, ambient noise received or picked up by the error microphone is also down-sampled by the decimator(s) 164 (165) and provided to the AHANCTU 142. The feedback filter 126 located in the AHANCTU 142 and operating at low sampling rates will be described in more detail below with reference to FIGS. 5-17.

The adaptive hybrid ANC training unit (AHANCTU) 142 also includes an input for receiving ANC specifications provided by a user. The adaptive hybrid ANC training unit (AHANCTU) 142 also includes a second input for receiving a digital audio signal at low sampling rates. The adaptive hybrid ANC system 100C may also include an equalizer or a dynamic range controller 173 for equalizing the desired audio signal to an equalized audio signal 174 and an interpolator 175 to convert the equalized audio signal to an audio signal 176 having an oversampling rate substantially equal to the sampling rate of the original digital reference microphone signal and error microphone signal.

Referring to FIG. 1C, the terms X(n), E(n), and A(n) refer to up-sampled or over-sampled discrete-time signals, which are a sequence of real or complex values. The signals x(n), e(n), and a(n) are down-sampled discrete-time signals corresponding to X(n), E(n), and A(n), respectively. The terms X(z), E(z), and A(z) refer to up-sampled or over-sampled signals in the complex frequency-domain representation.

In one embodiment, the hybrid adaptive ANC unit (HAANCU) 141 may be implemented in hardware or a combination of hardware and software, the adaptive hybrid ANC training unit (AHANCTU) 142 and the rate conversion unit (FCUANC) 143 may be implemented by a digital signal processor (DSP). As used herein, these units may include hardware and/or software components that are described in detail below. The term "unit" may also be referred to an apparatus, a device, or a system including hardware logic, memory, one or more processing units, and software logic running instructions to control operations of the adaptive noise cancellation system.

In one embodiment, the adaptive hybrid ANC system 100C may also include a programmable digital signal processor (not shown) configured to perform down-sampling (decimation), up-sampling (interpolation), and filter coefficients rate conversion. In one embodiment, the programmable digital signal processor may be a dedicated DSP device. In one embodiment, the programmable digital signal processor may have a distributed DSP architecture having a plurality of DSP units embedded in the decimator(s) 164 (165), the AHANCTU 142, the filter rate conversion unit FCTUANC 143, the ANC filters update unit 144, the hybrid adaptive ANC unit (HAANCU) 141, the equalizer or dynamic range controller (173), the interpolator (175), etc. In one embodiment, the ANC filters update unit 144 is located in the HAANCU 141. In one embodiment, the ANC filters update unit 144 is located in the FCTUANC 143.

II. Hybrid Adaptive ANC Unit (HAANCU)

Figure 2:
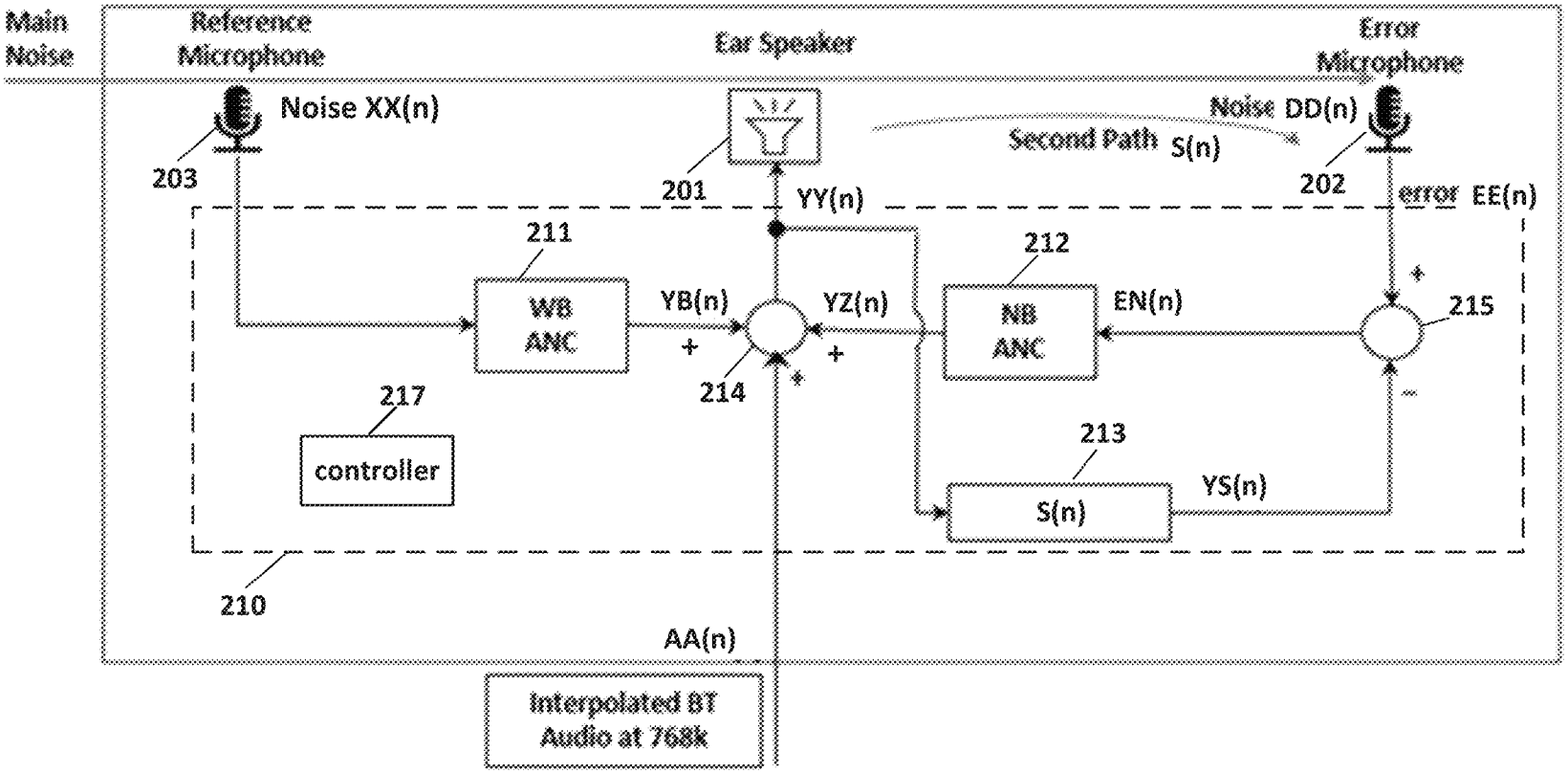
FIG. 2 is a simplified block diagram of an adaptive hybrid noise cancellation system when the adaptive ANC system including a secondary path is operating at high sampling rates according to an embodiment of the present disclosure.

FIG. 2 shows a simplified block diagram of an HAANCU system 200 used as a high sampling rate ANC according to an embodiment of the present disclosure. The HAANCU system 200 may be an audio device (e.g., a mobile phone, a noise reducing system, a portable personal audio listening device) or an ear piece that includes components relevant to improve the adaptive noise cancelation process. Referring to FIG. 2, the HAANCU system 200 includes an audio transducer (e.g., an ear speaker) 201, an error microphone 202 positioned close to the ear speaker 201, and a reference microphone 203 integrated in the audio device. The reference microphone 203 provides a reference noise signal XX(n) representative of a main noise (ambient noise). The error microphone 202 provides an error signal EE(n) representative of the main noise (ambient noise). The HAANCU system 200 also includes a hybrid noise cancellation circuit 210, which includes a wideband adaptive noise cancellation (WB ANC) filter 211, a narrowband adaptive noise cancellation (NB ANC) filter 212, a feedback filter 213 having an impulse response S(n) representing an acoustic path (secondary path denoted "Second Path") between the ear speaker and the error microphone, and a first adder 214 configured to add (sum or mix) wideband anti-noise YB(n) at the output of the WB ANC filter 211, the narrowband anti-noise YZ(n) at the output of the NB ANC filter 212, and a desired audio signal AA(n). The summed (mix) result YY(n) is provided to the ear speaker. The hybrid noise cancellation circuit 210 also includes a second adder 215, which sums a feedback noise signal YS(n) at the output of the feedback filter S(n) and the error signal EE(n) to generate an error noise signal EN(n) to the NB ANC filter 212. It is noted that the use of the terms first, second, etc. do not denote any order, but rather the terms first, second, etc. are used to distinguish one element from another. Furthermore, the use of the terms a, an, etc. does not denote a limitation of quantity, but rather denote the presence of at least one of the referenced items The hybrid noise cancellation circuit 210 further includes a controller 217 configured to update the coefficients of the WB ANC filter 211 and the NB ANC filter 212. The controller 217 modifies the coefficients of the WB ANC filter 211 and the NB ANC filter 212 in real-time by performing digital addition, subtraction, multiplication to reduce the error noise signal EN(n) at the input of the NB ANC filter 212. The controller 217 may include a real-time digital signal processor (DSP) including nonvolatile memory, random access memory and software programs for updating the transfer functions of the WB ANC filter 211 and the NB ANC filter 212. In one embodiment, the controller includes one or more DSP modules that are centralized to update the coefficients of the WB ANC filter 211 and the NB ANC filter 212 in real time. In one embodiment, the controller 217 may include one or more DSP modules that are distributed in the WB ANC filter 211 and the NB ANC filter 212 to perform real-time update of the filter coefficients.

The error microphone 202 is configured to pick up the summed sound of the ear speaker just before the user's inner ear, the summed sound may include the audio signal AA(n), the wideband anti-noise YB(n), and the narrowband anti-noise YZ(n). The reference microphone 203 is configured to pick up background acoustic noise, but not the sound emitted by the ear speaker. Ideally, the anti-noise is the same as the noise but with an inverted phase in the inner ear area to prevent noise from entering the user's inner ear, i.e., the anti-noise cancels the noise before it enters the user's inner ear. In this case, a signal received by the error microphone is reduced or eliminated. It is noted that the audio signal AA(n) is shown as oversampled at 768 ksamples/s, however, it is understood that this sampling rate is arbitrary chosen for describing the example embodiment and should not be limiting. In some embodiment, the sampling rate can be chosen within a sampling rate range having an upper and lower limits different from this sampling rate value.

As used herein, the reference symbols YB(n), YY(n), YZ(n), XX(n), EN(n), EE(n), DD(n), AA(n) and AI(n) denote time sequences of discrete values in the time-domain, where n is the sampling time index. However, the embodiment is not limited to the time-domain processing operations. One of skill in the art would understand that the digital signal processing may be performed in the frequency domain through transform operations from the time domain into the frequency domain. The reference symbols S(n), S'(n) denote the time domain impulse response of the feedback filter 213, the reference symbols S(z), S'(z) represent the discrete frequency domain of the feedback filter 213.

The input to the WB ANC filter 211 is a signal from the reference microphone that captures noise before the noise travels to the user's inner ear. The WB ANC filter output is a wideband anti-noise because it can cancel noise up to a few thousands of Hertz.

The NB ANC filter output is a narrowband anti-noise because it cancels noise in narrowband and/or tonal noises. The input to the NB ANC filter 212 is the noise estimated from the error signal via adding the synthesized noise filtered with an estimated secondary path impulse response. The signal traveling path from the ear speaker to the error microphone including ADC and DAC converters (not shown) is referred to as a secondary path and modeled as S(n). Since the signal captured by the error microphone is the mix of the noise and the anti-noise, the noise is obtained via removing the anti-noise signal from the error microphone signal. It is critical to model the secondary path as accuracy as possible in the frequency range of interest because the audio input may negatively affect the NB ANC performance.

In accordance with the present invention, the high speed adaptive ANC system has the following advantages:

(1) There is less delay or low latency using hardware processing and the adaptive secondary path because the system operates at hardware speed.

(2) It requires little processing power because most of processing is done in other units and the processing in the unit has just three sets of filtering operations: wideband (WB) filtering, narrowband (NB) filtering, and secondary path filtering. In one embodiment, the infinite impulse response (IIR) filters are advantageously employed due to the small number of coefficients.

The novel feature in this system is that all of the coefficients are updated in real-time although their adaptation is in the AHANCTU. Since the AHANCTU runs at very low speed, its hardware usage, such as memory usage, is small. For example, each tap of an adaptive filter represents 1/fs time, where fs is the sampling frequency, and the number of taps for a filter is small if fs is small. Accordingly, its computation cycles are also small. The AHANCTU will be described in more detail further below.

The coefficients used in the unit are updated from the FCUANC and the update rate is selectable. For example, the coefficients can be updated every sample time of AHANCTU. If the sample rate is 16 ksamples/s, the update period can be 1/16 ms. Other update data periods can also be selected.

Figure 3:
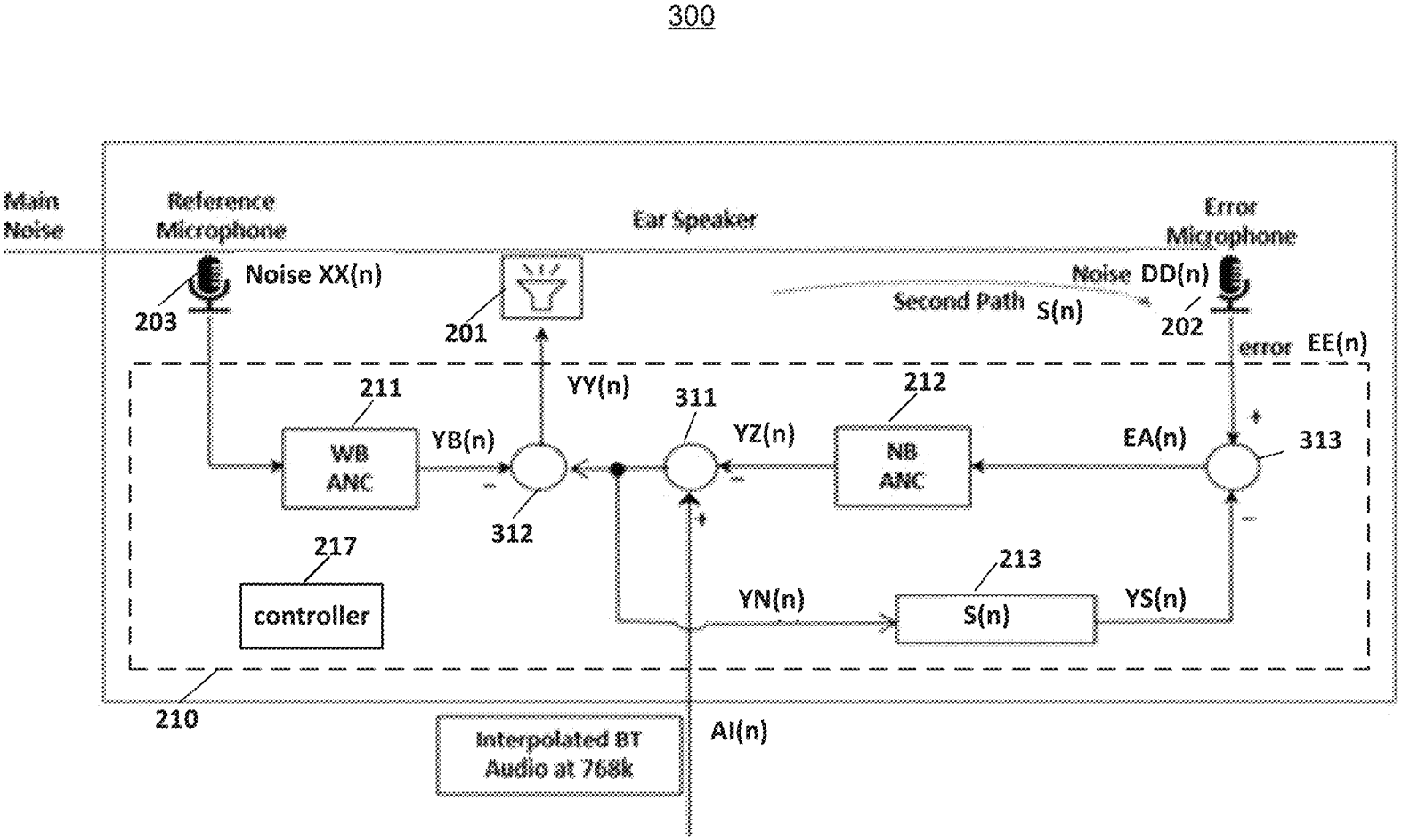
FIG. 3 is a simplified block diagram of an adaptive hybrid noise cancellation system when the adaptive ANC system including a secondary path is operating at high sampling rates according to another embodiment of the present disclosure.

FIG. 3 an example block diagram of a hybrid adaptive active noise cancellation unit (HAANCU) system 300 according to another embodiment of the present disclosure. The main difference between the systems in FIG. 3 and FIG. 2 is the input to the NB ANC filter. Since only the feedback noise YS(n) is subtracted from the error signal EE(n) of the error microphone, the reference to the NB ANC filter 212 is a residual error noise signal EA(n) after the WB ANC filter. In this way, the NB ANC filter can focus on the low-frequency range and tonal-like peaks in the residual error noise signal EA(n) after the WB ANC operation.

Referring to FIG. 3, the hybrid adaptive active noise cancellation (HAANCU) system 300 includes an audio transducer (e.g., an ear speaker) 201, an error microphone 202 positioned close to the ear speaker, and a reference microphone 203 integrated in the audio device. The HAANCU system 300 also includes a hybrid noise cancellation circuit 210, which includes a wideband adaptive noise cancellation (WB ANC) filter 211, a narrowband adaptive noise cancellation (NB ANC) filter 212, and a feedback filter 213 having an impulse response S(n) representing an acoustic path between the ear speaker and the error microphone. Their functions and operations have been described above and will not be repeated herein.

The hybrid adaptive active noise cancellation system 300 also includes a first adder 311 configured to generate a narrowband feedback signal YN(n) from the wideband anti-noise signal YB(n) at the output of the WB ANC filter 211 and a desired audio input signal AI(n). The hybrid adaptive active noise cancellation system 300 also includes a second adder 312 coupled to the WB ANC filter and the first adder and configured to provide a noise-reduced audio signal YY(n) to the ear speaker. The hybrid adaptive active noise cancellation system 300 also includes a third adder 313 configured to generate a residual error signal EA(n) from the error signal EE(n) and the feedback signal YS(n).

Figure 4:
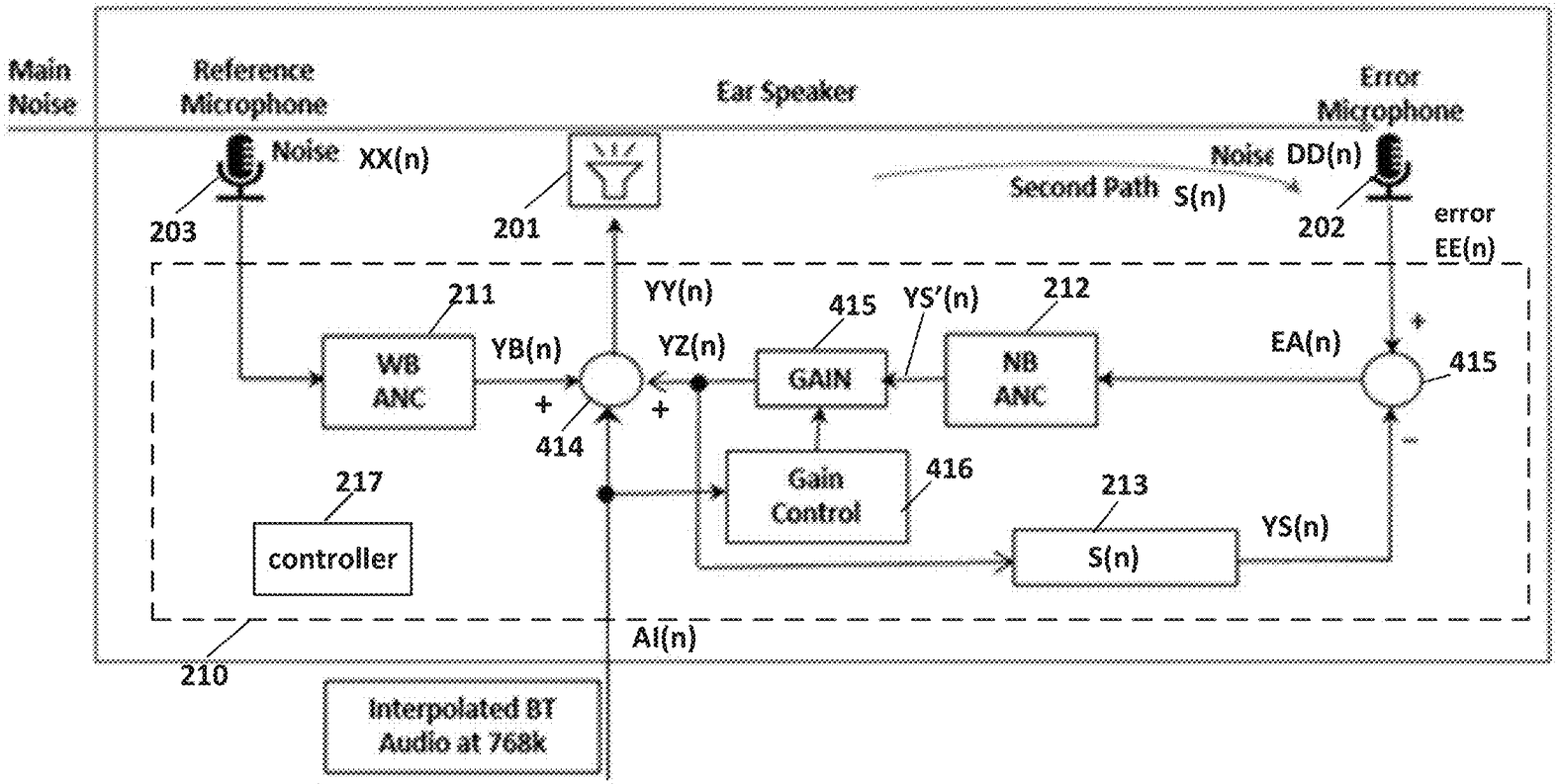
FIG. 4 is a simplified block diagram of an adaptive hybrid noise cancellation system when the adaptive ANC system including a secondary path is operating at high sampling rates according to still another embodiment of the present disclosure.

FIG. 4 is a simplified block diagram illustrating an HAANCU architecture used in an adaptive hybrid ANC system 400 according to an embodiment of the present disclosure. The main difference between the adaptive hybrid ANC system 400 and the adaptive hybrid ANC system 200 is that there is a GAIN circuit (e.g., an amplifier) 415 to adjust attenuation based on information of the audio signal to be played. The Gain circuit 415 is controlled by a gain control circuit 416 based on the amplitude of the audio signal AI(n). For example, since NB ANC performance depends on the accuracy of the secondary path model, the NB ANC effect can be reduced when the audio signal is strong by reducing the GAIN. In one embodiment, the GAIN can be set to zero when an audio active detection is positive.

Referring to FIG. 4, the hybrid adaptive active noise cancellation system 400 includes an audio transducer (e.g., an ear speaker) 201, an error microphone 202 positioned close to the ear speaker, and a reference microphone 203 integrated in the audio device. The HAANCU system 400 also includes a hybrid noise cancellation circuit 210, which includes a wideband adaptive noise cancellation (WB ANC) filter 211, a narrowband adaptive noise cancellation (NB ANC) filter 212, and a feedback filter 213 having an impulse response S(n) representing an acoustic (secondary) path between the ear speaker and the error microphone. Their functions and operations have been described above and will not be repeated herein. It is noted that S(z) denotes the discrete frequency domain of the feedback filter 213, and S(n) denotes the discrete time domain impulse response of the feedback filter 213. It is also noted that the following disclosure describes the hybrid active noise control filter adaptation in the discrete time domain, one skilled in the art will appreciate that the described techniques can also be performed in the frequency domain.

The hybrid adaptive active noise cancellation system 400 also includes a first adder 414 configured to provide a noise-reduced signal YY(n) to the ear speaker from a wideband anti-noise signal YB(n) at the output of the WB ANC filter 211, an amplified (scaled) narrowband anti-noise YZ(n) at the output of the variable gain amplifier (GAIN) 415 which receives an NB anti-noise YZ'(n) from the NB ANC filter 212, and a desired audio input signal AI(n). The hybrid noise cancellation circuit 210 also includes a second adder 415, which sums a feedback noise signal YS(n) at the output of the feedback filter S(n) and the error signal EE(n) to generate an error noise signal EA(n) to the NB ANC filter 212.

There are many other realizations of high-speed hybrid ANC. For example, some embodiments of the feedback ANC directly use signal of the error microphone as its input. The principle is based on the control theory and NB ANC design is a controller design. Many analog NB ANC filters are based on this principle.

III. Adaptive Hybrid ANC Training Unit (AHANCTU)

Signal processing for obtaining filter coefficients are performed in this unit, which typically is a DSP or the like. Signals to the unit are with lower sampling rates so that the signal processing operations require much lower processing power and computational complexity as measured in MIPS (millions of instructions/s) and memory than when directly processing in a high-speed (high sampling rate) unit.

Referring to FIG. 1C, signals from both the reference microphone and error microphone are decimated to lower sampling rates. The rate running in a DSP device depends on the frequency range of ANC to achieve noise reduction and ANC performance specifications. In an example embodiment, performance requirements are specified up to 4 kHz, the sampling rate for signals processed in DSP can be 8 ksamples/s. Other sampling rates can be used while 8 ksamples/s may be optimal in terms of processing and memory cost.

Figure 5:
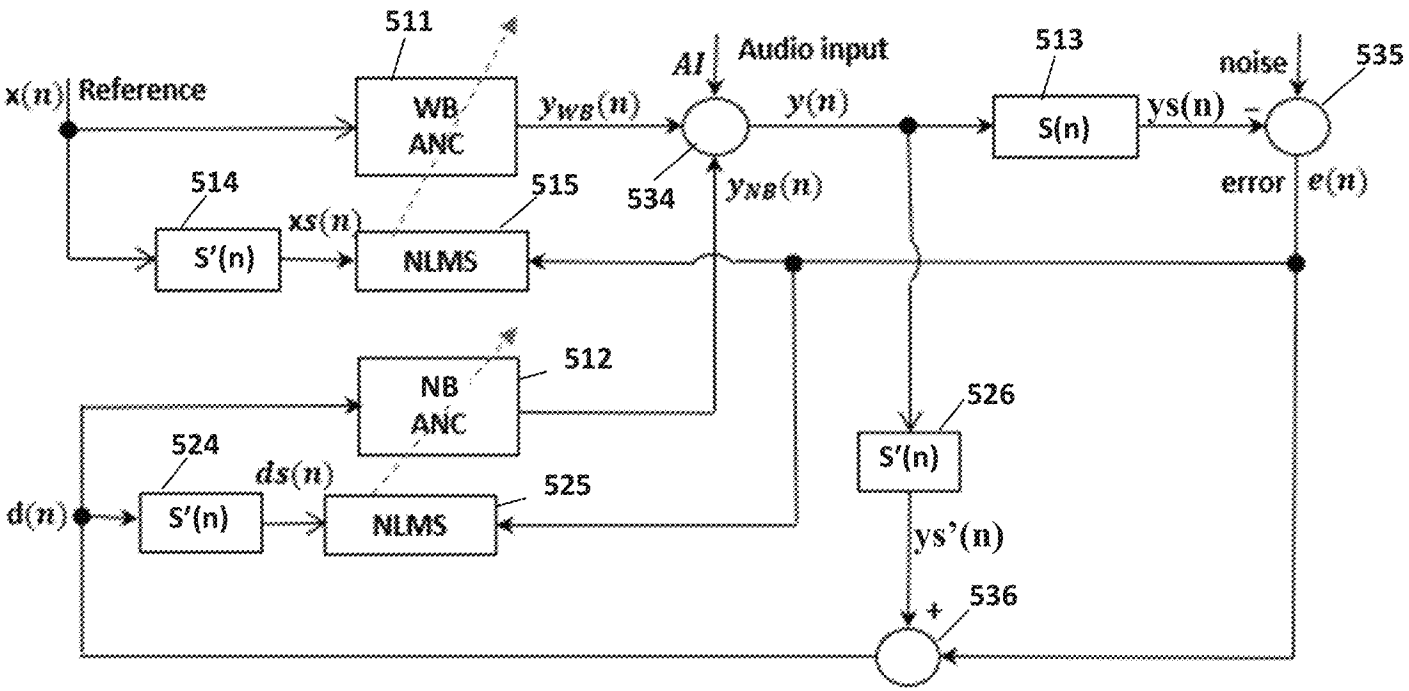
FIG. 5 is a simplified block diagram of an adaptive hybrid noise cancellation system with an additional modeled secondary path operating at low sampling rates according to an embodiment of the present disclosure.

FIGS. 5-9 illustrate various embodiments of an active noise cancellation system. Some components showed in those embodiments are described and illustrated continuously in those embodiments as they appear in multiple of those embodiments. For example, a same component may appear in FIG. 5 and FIG. 9; and this component is described in association with FIG. 5 and thus is not repeated in the description associated with FIG. 9. FIG. 5 is a simplified block diagram of an active noise cancellation system 500 operating at low sampling rates according to an embodiment of the present disclosure. The active noise cancellation system 500 is shown to include adaptation of filters for hybrid WB and NB ANCs in a low sampling rate unit. The active noise cancellation system 500 has a structure similar to that shown in FIG. 2 with the exception that there are adaptation blocks in the training unit. However, it is running in a much lower sampling rate and preferred to be realized with software via DSP or like device. It also includes an adaptation block which is not required for high speed unit as shown in FIG. 2. Referring to FIG. 5, the active noise cancellation system 500 includes a wideband adaptive noise cancellation (WB ANC) filter 511, a narrowband adaptive noise cancellation (NB ANC) filter 512, a feedback filter S(n) 513 which represents the impulse response of the secondary path, and a modeled feedback filter S'(n) 514 which is a modeling of the secondary path S(n) at a lower sampling rate. Note that S(n) shown in FIG. 5 is a low-sampling rate version of S(n) of FIGS. 2, 3, and 4, where the sampling rate is much higher. It is further noted that S(n) is not available and it is the same as S'(n) in this AHANCTU unit. The modeling of the secondary path S(n) will be trained, i.e., the modeled feedback filter S'(n) is trained to adapt its filter coefficients to have a transfer function or an impulse response representative of the secondary path at low sampling rates. The active noise cancellation system 500 also includes a first adder 534 configured to provide a noise-reduced audio signal from the wideband anti-noise signal $y_{WB}(n)$, the narrowband anti-noise signal $y_{NB}(n)$ and a desired audio signal AI. The active noise cancellation system 500 also includes a second adder 535 configured to provide an error signal e(n) from the noise signal "noise" from the error microphone (not shown) and the feedback noise signal ys(n) of the feedback filter S(n). The active noise cancellation system 500 further includes a first normalized least mean square (NLMS) filter 515 disposed between the first modeled feedback filter S'(n) 514 and the second adder 535 and a second NLMS filter 525 disposed between the second modeled feedback filter S'(n) 524 and the second adder 535. The first and second NLMS filters 515, 525 can be a normalized least mean square (NLMS) adaptive algorithm or other adaptive filtering algorithms. The active noise cancellation system 500 further includes a third adder 536 configured to provide an estimated noise signal d(n) from a modeled noise-reduced audio signal ys'(n) and the error signal e(n). The estimated noise signal d(n) is to be canceled at the error microphone and is used as NLMS reference for training the NB ANC filter. In one exemplary embodiment, the reference noise signal x(n), the desired audio input signal AI, the noise signal picked up by the error microphone are down-sampled to 48 k samples/s or lower, such that the active noise cancellation system 500 can be operated at a very clock frequency.

The WB ANC filter 511 is adaptively trained with the reference microphone signal x(n) as reference and the error microphone signal for WB filter update. The NB ANC filter 512 is adaptively trained with an estimated noise signal d(n) as reference and error microphone signal e(n) for NB filter update. A mathematical presentation for the active noise cancellation system 500 is described below.

Let the reference signal down-sampled from reference microphone signal be x(n) and error signal down-sampled from error microphone signal be e(n), where n is a sampling time index, then y(n) is the anti-noise signal plus the audio input (AI):

$$y(n)=y_{WB}(n)+y_{NB}(n)+AI(n) \tag{1}$$

In which $y_{WB}(n)$ is the output signal of the WB ANC and equals to $$y_{WB}(n)=x(n)\otimes WB(n) \tag{2}$$

WB(n) is the adaptive filter of WB ANC and the operator ⊗ is the convolution or filtering. Similarly, $y_{NB}(n)$ is the output signal of the NB ANC and equals to $$y_{NB}(n)=d(n)\otimes NB(n) \tag{3}$$

Where d(n) is the noise signal in the inner ear area and NB(n) is the adaptive filter of the NB ANC. The error signal is $$e(n)=d(n)-y(n)\otimes S(n) \tag{4}$$

Since d(n) is not directly available, it is estimated from $$d(n)=e(n)+y(n)\otimes S'(n) \tag{5}$$

According to a normalized least mean square (NLMS) algorithm, the WB and NB ANC filters are updated according to $$WB(n,k)=WB(n,k)+2*\mu1(n)*e(n)*xs(n-k) \tag{6}$$

Where μ1(n) is a normalized adaptation coefficient, xs(n) is x(n)⊗S'(n) and forms so-called filtered-X LMS operation. And $$NB(n,k)=NB(n,k)+2*\mu2(n)*e(n)*ds(n-k) \tag{7}$$

Where μ2(n) is a normalized adaptation coefficient, and ds(n) is d(n)⊗S'(n).

The above mathematic operations can be realized via both hardware and software. In one embodiment, software is used for high implementation flexibility because other adaptive algorithms can be easily replaced.

The error signal contains the audio signal, which must be handled to prevent divergence of an adaptive filtering algorithm. The simplest way to remove audio effect is to freeze adaptation when the audio signal is active. In another embodiment, a variable step size for adaptive filtering algorithm may be used where adaptation is a function of ratio of the audio signal to the residual noise signal in the error microphone signal.

Figure 6:
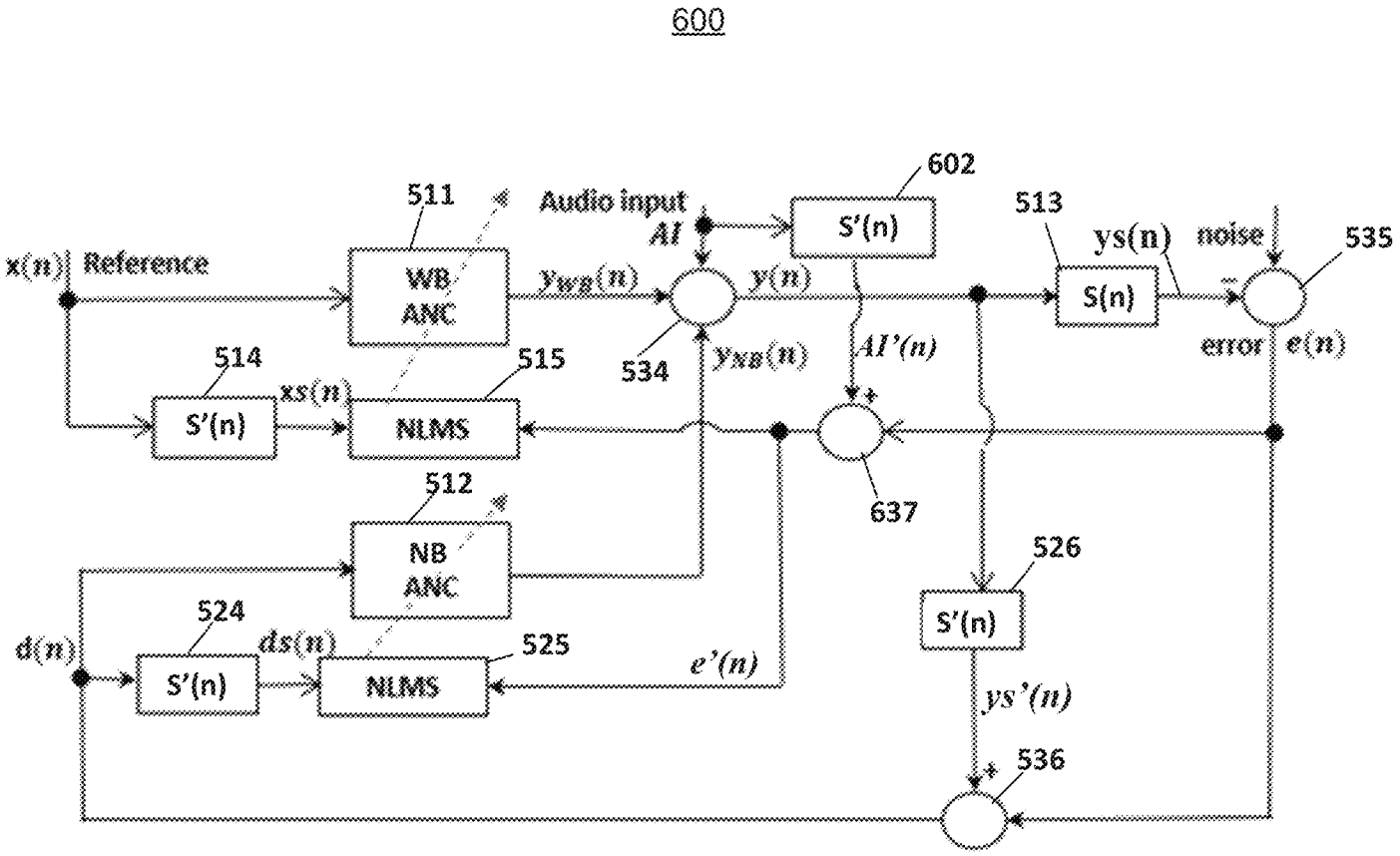
FIG. 6 is a simplified block diagram of an adaptive hybrid noise cancellation system with audio effects removed according to an embodiment of the present disclosure.

FIG. 6 is a simplified block diagram of an active noise cancellation system 600 for adaptive training of the hybrid ANC, in which the audio signal is removed from the error signal for WB filter adaptation according to an embodiment of the present disclosure. The active noise cancellation system 600 is similar to that of FIG. 5 with the difference that the audio signal AI is filtered by the modeled feedback filter 602 representing a secondary path S'(n) as shown, and the filtered audio signal AI'(n) is added to the error signal e(n) by a fourth adder 637 so that the error signal e'(n) is free of the audio signal. Referring to FIG. 6, the audio signal AI is removed from the error microphone signal e(n) via subtracting the secondary path filtered audio signal AI'(n).

Both systems shown in FIG. 5 and FIG. 6 use the error signal for adaptive filter adaptation. The algorithms may not work well because the convergence degree of the WB ANC filter and NB ANC filter may be different so that update of which filter is confusing with the adaptive filtering algorithm with the same error microphone signal. Thus, the state of the WB ANC adaptive filter may negatively affect the state of the NB ANC adaptive filter unless the WB ANC filter is first trained and then the NB ANC filter is trained after the WB ANC filter converges or vice versa. This may be good for offline filter training operations.

Figure 7:
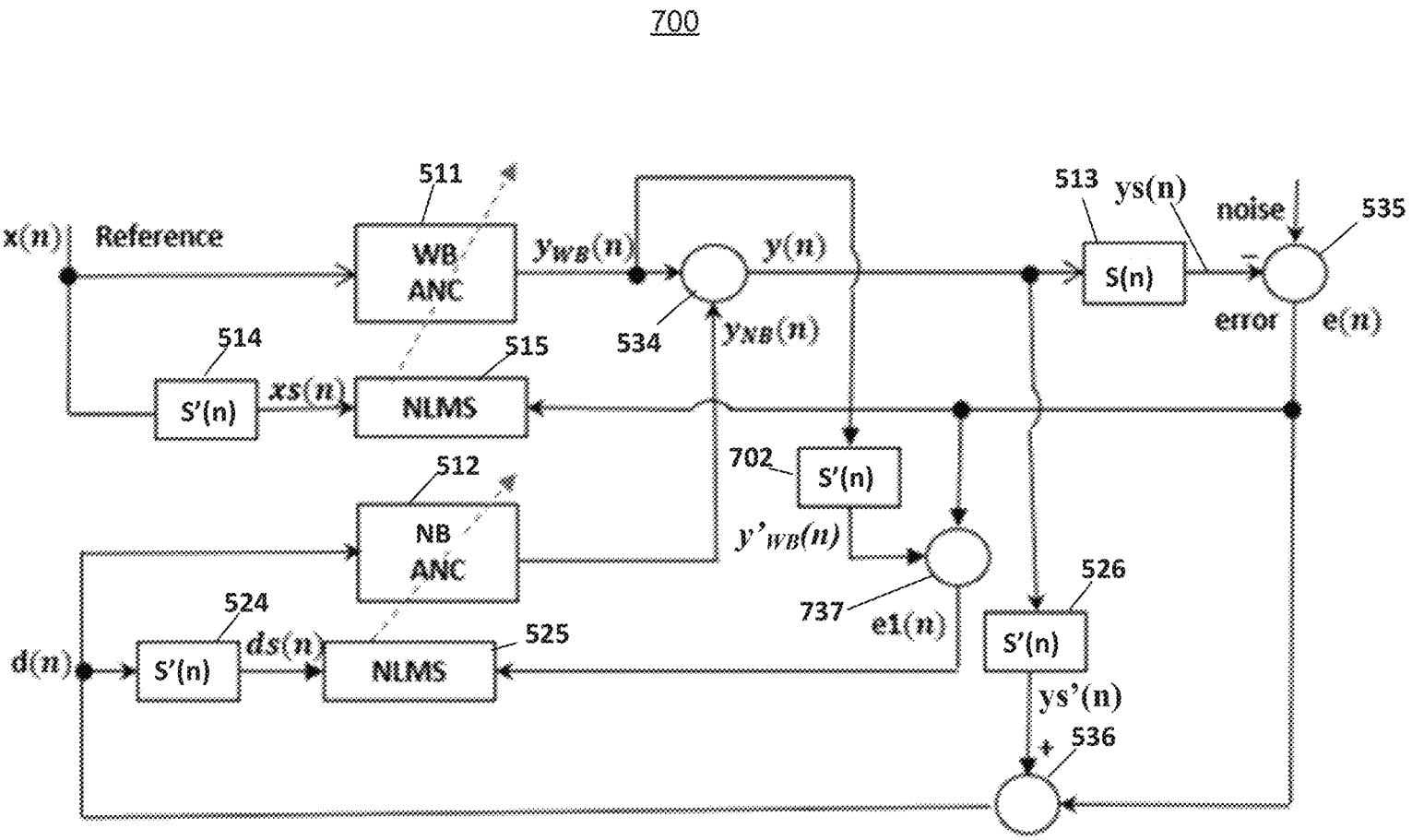
FIG. 7 is a simplified block diagram of an adaptive hybrid noise cancellation system where both the wideband ANC filter and the narrowband ANC filter are trained at the same time according to an embodiment of the present disclosure.

FIG. 7 is a simplified block diagram of an active noise cancellation system 700 where both the wideband ANC filter 511 and the narrowband ANC filter 512 are trained concurrently (at the same time) according to an embodiment of the present disclosure. The main feature of this embodiment is that the reference to the NB ANC filter is noise d(n) while the error signal for the NB ANC adaptive filter training is the residual noise after NB ANC only. Thus, the NB ANC filter training is dependent of itself and independent of the WB ANC filter training. The convergence behavior is controllable. The WB ANC filter cancels noise left after the NB ANC noise cancellation. The difference between this embodiment and the embodiment of FIG. 6 can be presented by replacing e(n) in Equation (7) with the following equation at the output of an adder 737:

$$e1(n)=e(n)+y_{WB}(n)\otimes S'(n) \tag{8}$$

Where e1(n) is an error signal including the error signal e(n) and a convoluted WB anti-noise signal $y'_{WB}(n)$ as a result of a convolution of the WB anti-noise signal $y_{WB}(n)$ with the modeled second modeled feedback filter S'(n) 702 so that $$NB(n,k)=NB(n,k)+2*\mu2(n)*e1(n)*ds(n-k) \tag{9}$$

Figure 8:
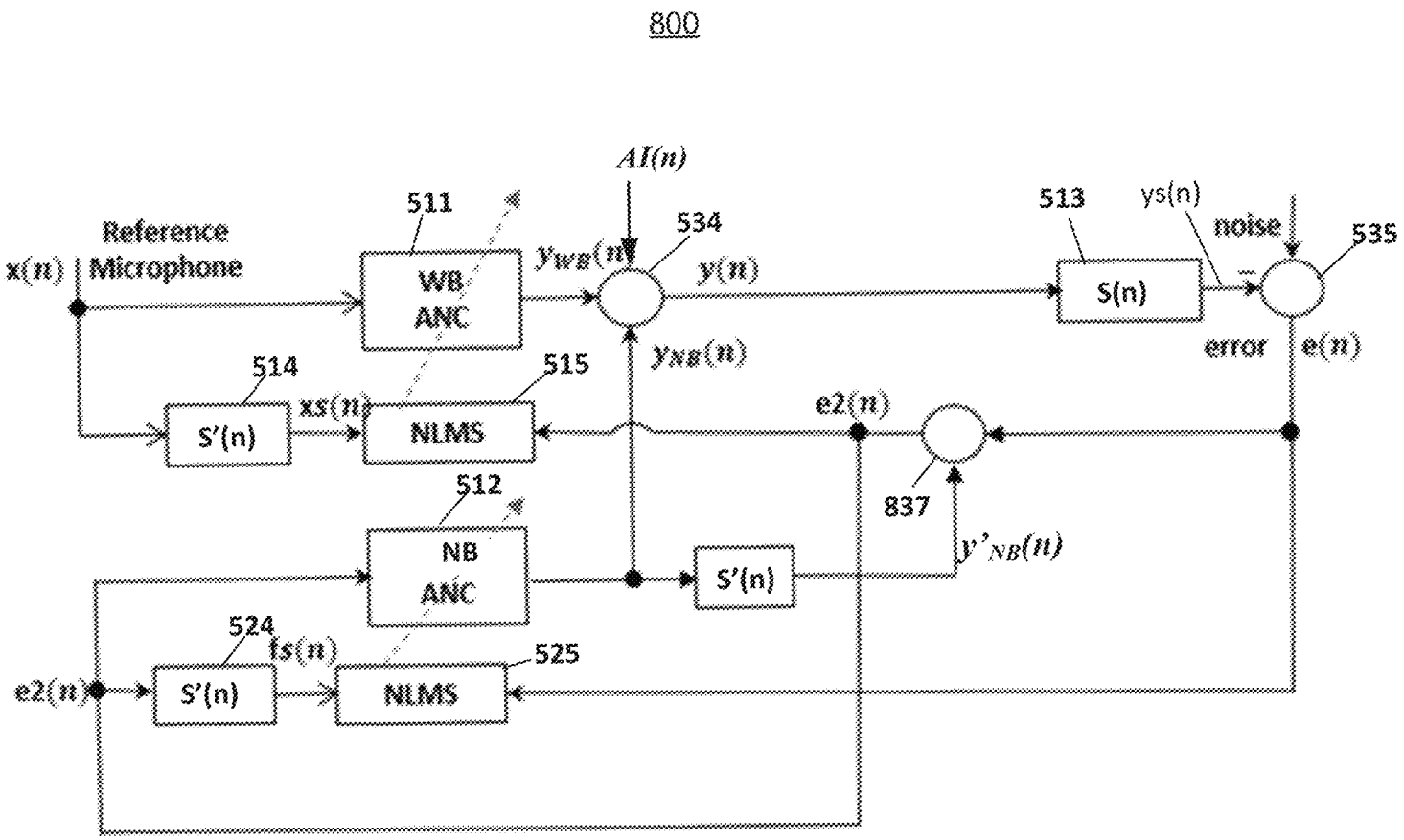
FIG. 8 is a simplified block diagram of an adaptive hybrid noise cancellation system where both the wideband ANC filter and the narrowband ANC filter are trained at the same time according to another embodiment of the present disclosure.

FIG. 8 is a simplified block diagram of an active noise cancellation system 800 where both the wideband ANC filter 511 and the narrowband ANC filter 512 are trained at the same time according to another embodiment of the present disclosure. The main feature of this embodiment is that the reference signal to the WB ANC filter is the reference signal x(n) while the error signal is the residual error after the WB ANC filtering only. Thus, the WB ANC filter training is dependent on itself and independent of the NB ANC filter training. The convergence behavior is controllable. The reference signal to the NB ANC filter is the residual error e2(n) after WB ANC and the error signal e(n) is from the down-sampled error signal of the error microphone. The difference between this embodiment and the embodiment of FIG. 6 can be presented by replacing e(n) in Equation (6) with the following equation at the output of an adder 837:

$$e2(n)=e(n)+y_{NB}(n)\otimes S'(n) \tag{10}$$

So that $$WB(n,k)=WB(n,k)+2*\mu1(n)*e2(n)*xs(n-k) \tag{11}$$

And replace d(n) in Equation (5) with e2(n) for Equation (7):

So that $$NB(n,k)=NB(n,k)+2*\mu2(n)*e2(n)*fs(n-k) \tag{12}$$

Where fs(n) is e2(n)⊗S'(n).

Figure 9:
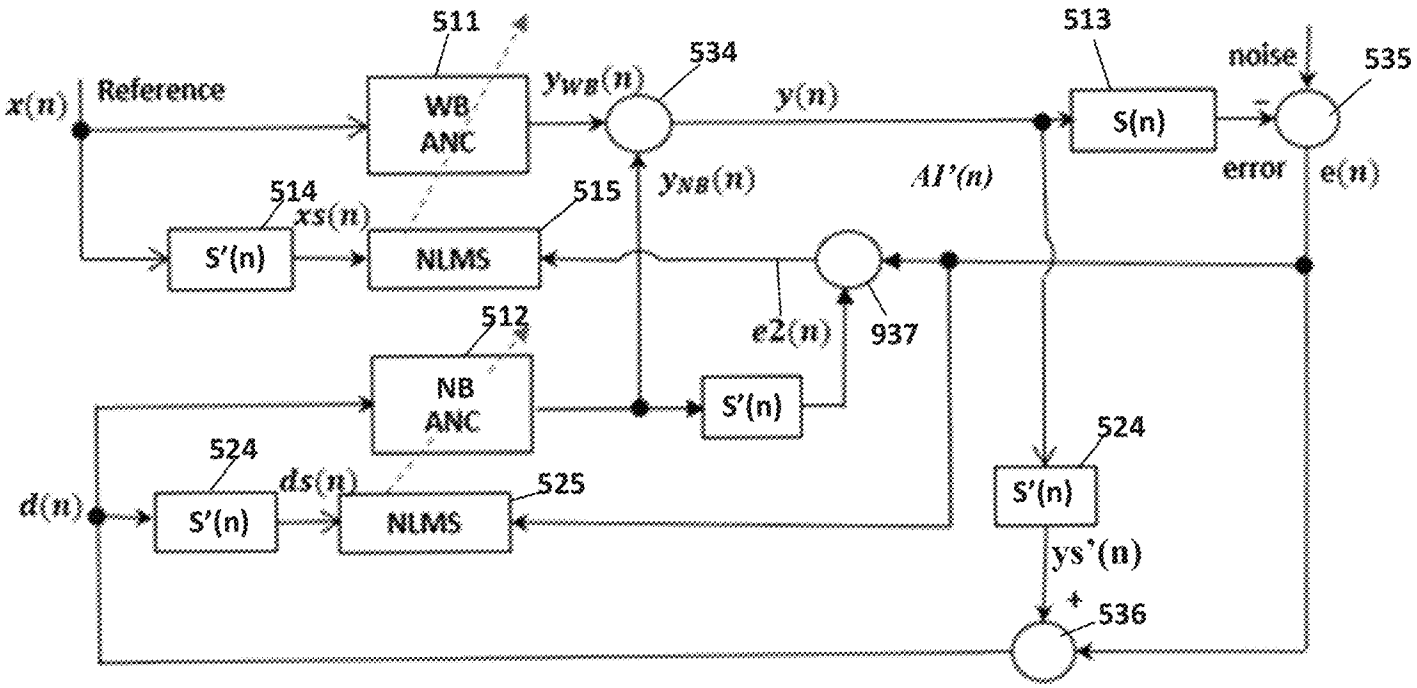
FIG. 9 is a simplified block diagram of an adaptive hybrid noise cancellation system with a modeled secondary path according to an embodiment of the present disclosure.

FIG. 9 shows a system similar to the system shown in FIG. 8 in which both the WB ANC filter 511 and the NB ANC filter 512 can be trained concurrently (at the same time). The main difference is that the reference signal to the NB ANC filter is the noise signal. Thus, the output signal e2(n) at an adder 937 is obtained by replacing e(n) in Equation (6) with the following equation:

$$e2(n)=e(n)+y_{NB}(n)\otimes S'(n) \tag{13}$$

So that $$WB(n,k)=WB(n,k)+2*\mu1(n)*e2(n)*xs(n-k) \tag{14}$$

The system in FIG. 9 further differs from the system in FIG. 8 by having the adder 536 configured to generate the noise signal d(n) from the modeled noise-reduced audio signal ys'(n) and the error signal e(n) and a modeled noise signal ds(n) to the NLMS filter 525.

The training units shown from FIG. 5 to FIG. 9 are powerful and can advantageously be implemented with a DSP operating at a low speed. The filters can be FIR and/or IIR filter types. If equations from (1) to (14) were to be implemented at higher speeds (e.g., at a sampling rate of N times higher than the Nyquist rate), all operations would be running at N times the speed (Nyquist rate). In addition, suppose that the filters are finite impulse response (FIR) filters operating at a sampling rate fs with M taps for each filter, the taps for the filter in the high-speed unit is M*N taps. A large memory size and a high amount of MIPS are required.

However, more effective ways to perform training operations exist in terms of operations and memory buffers. The performance improvement may benefit from the new filter training structures due to a centralized secondary path processing. FIG. 10 to FIG. 13 illustrate novel devices and systems that have more efficient structures.

Systems shown in FIG. 10 to FIG. 13 are simplified structures from the structures shown in FIG. 5 and from FIG. 7 to FIG. 9, respectively. The main feature in theses embodiments is that secondary path filtering operations are combined so that only reference signals for both WB and NB ANC operations are filtered with the secondary path impulse response. The mathematical presentation for these structures are described below. In these structures, the audio input signal is omitted for simplicity and clarity of illustration. Further, for the sake of clarity, reference numerals that have been provided to elements in previous figures will be omitted and further description will not be repeated hereinafter.

Figure 10:
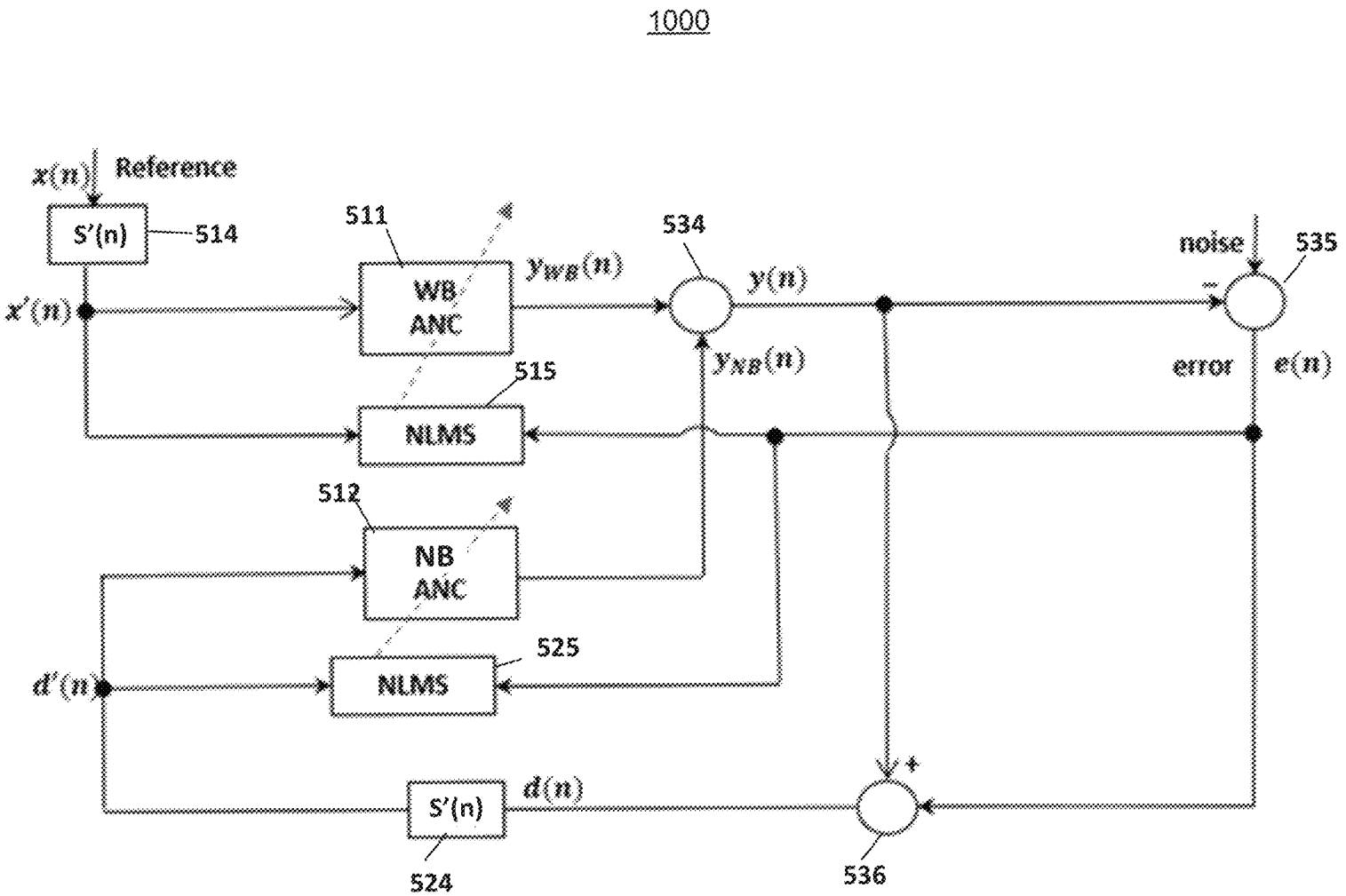
FIG. 10 is a simplified block diagram of an adaptive hybrid noise cancellation system similar to that of FIG. 5 with a combined modeled secondary path for both the WB ANC unit and the NB ANC unit according to an embodiment of the present disclosure.

Referring to FIG. 10, the signals x'(n), d'(n) and y(n) are obtained:

$$x'(n)=x(n)\otimes S'(n) \tag{15}$$

$$d'(n)=d(n)\otimes S'(n) \tag{16}$$

$$y(n)=y_{WB}(n)+y_{NB}(n) \tag{17}$$

In which $y_{WB}(n)$ is the output of WB ANC and equals to $$y_{WB}(n)=x'(n)\otimes WB(n) \tag{18}$$

WB(n) is the adaptive filter of WB ANC and the operator ⊗ is the convolution. Similarly, $y_{NB}$ (n) is the output of NB ANC and equals to $$y_{NB}(n)=d'(n)\otimes NB(n) \tag{19}$$

Where d(n) is the noise in the inner ear area and NB(n) is the adaptive filter of NB ANC. The error signal is $$e(n)=d(n)-y(n) \tag{20}$$

Since d(n) is not directly available, it is estimated from $$d(n)=e(n)+y(n) \tag{21}$$

According to the normalized least mean square (NLMS) algorithm, the WB and NB ANC filters are updated according to $$WB(n,k)=WB(n,k)+2*\mu1(n)*e(n)*x'(n-k) \tag{22}$$

Where μ1(n) is a normalized adaptation coefficient, and $$NB(n,k)=NB(n,k)+2*\mu2(n)*e(n)*d'(n-k) \tag{23}$$

Where μ2(n) is a normalized adaptation coefficient.

Hardware, firmware, software, or a combination thereof may be used to implement the above mathematic operations. In some embodiments, software solutions are used for the implementation because a user can easily replace the operations with other adaptive algorithms.

Figure 11:
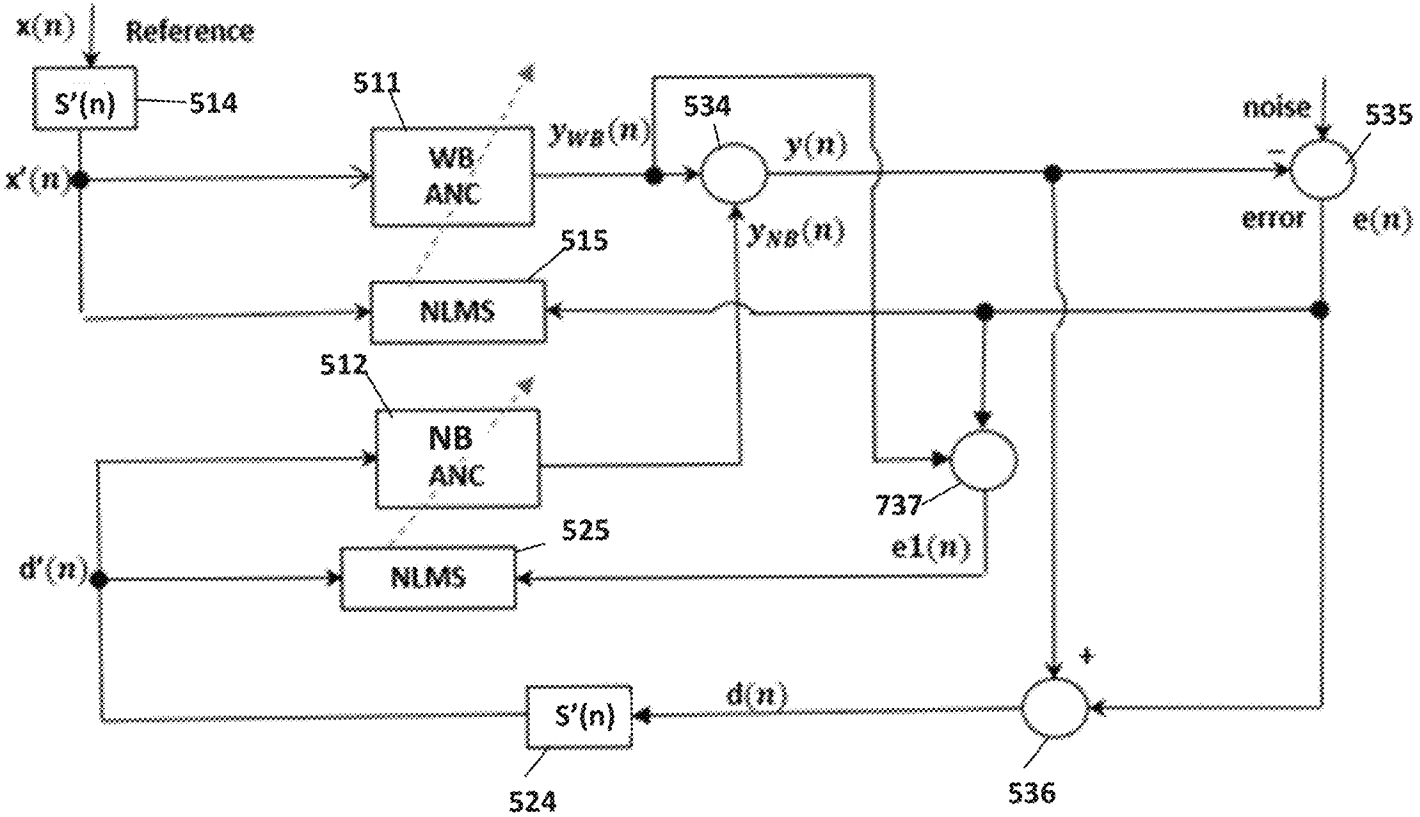
FIG. 11 is a simplified block diagram of an adaptive hybrid noise cancellation system similar to that of FIG. 7 with a combined modeled secondary path for both the WB ANC unit and the NB ANC unit according to another embodiment of the present disclosure.

From FIG. 11, we see that:

$$e1(n)=e(n)+y_{WB}(n) \tag{24}$$

So that $$NB(n,k)=NB(n,k)+2*\mu2(n)*e1(n)*d'(n-k) \tag{25}$$

Figure 12:
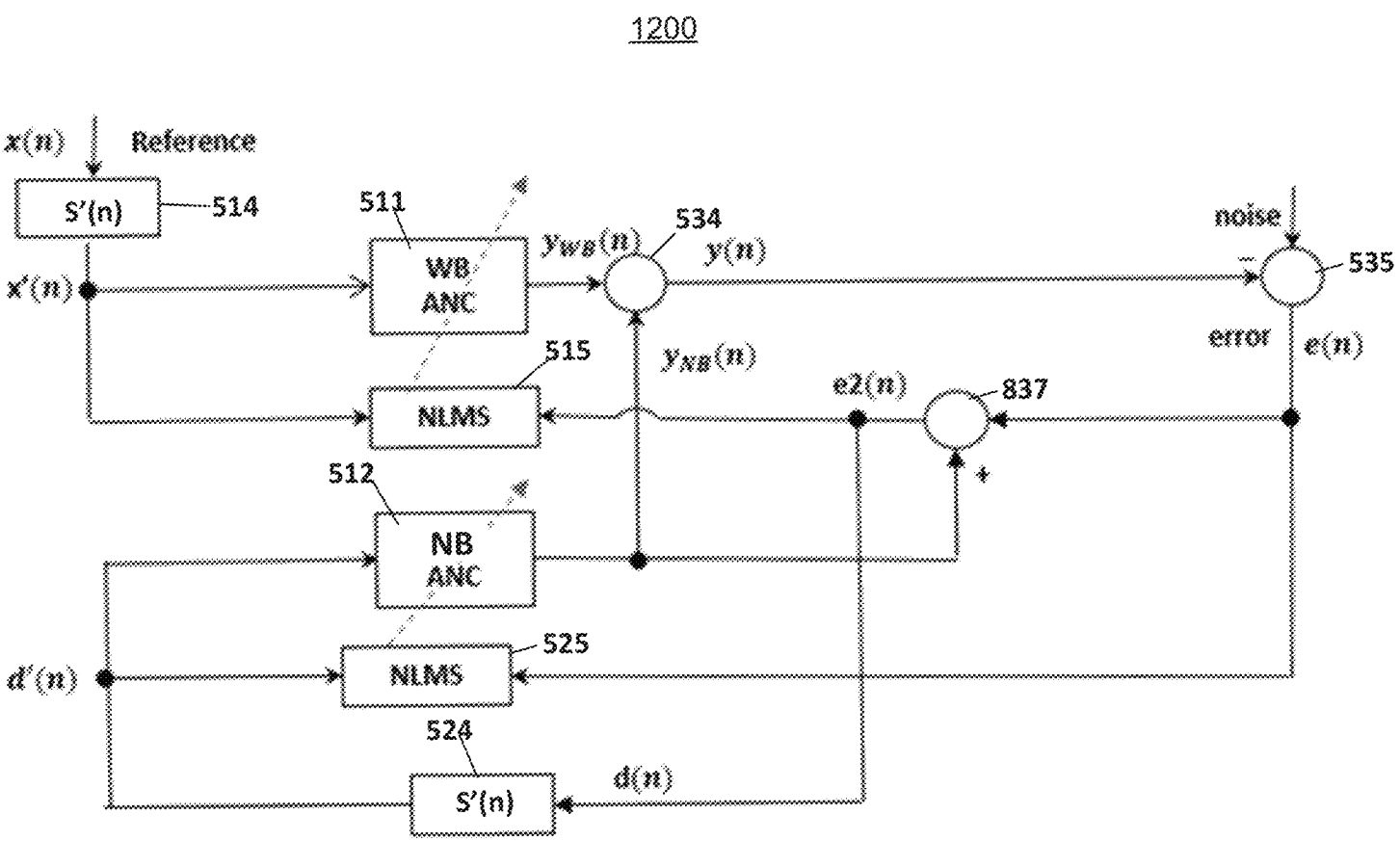
FIG. 12 is a simplified block diagram of an adaptive hybrid noise cancellation system similar to that of FIG. 8 with a combined modeled secondary path for both the WB ANC unit and the NB ANC unit according to yet another embodiment of the present disclosure.

From FIG. 12, we see that:

$$e2(n)=e(n)+y_{NB}(n) \tag{26}$$

So that $$WB(n,k)=WB(n,k)+2*\mu1(n)*e2(n)*x'(n-k) \quad (27)$$

And replace d(n) in Equation (5) with e2(n) for Equation (7) and notice Equation 16:

So that $$NB(n,k)=NB(n,k)+2*\mu2(n)*e(n)*d'(n-k) \quad (28)$$

Figure 13:
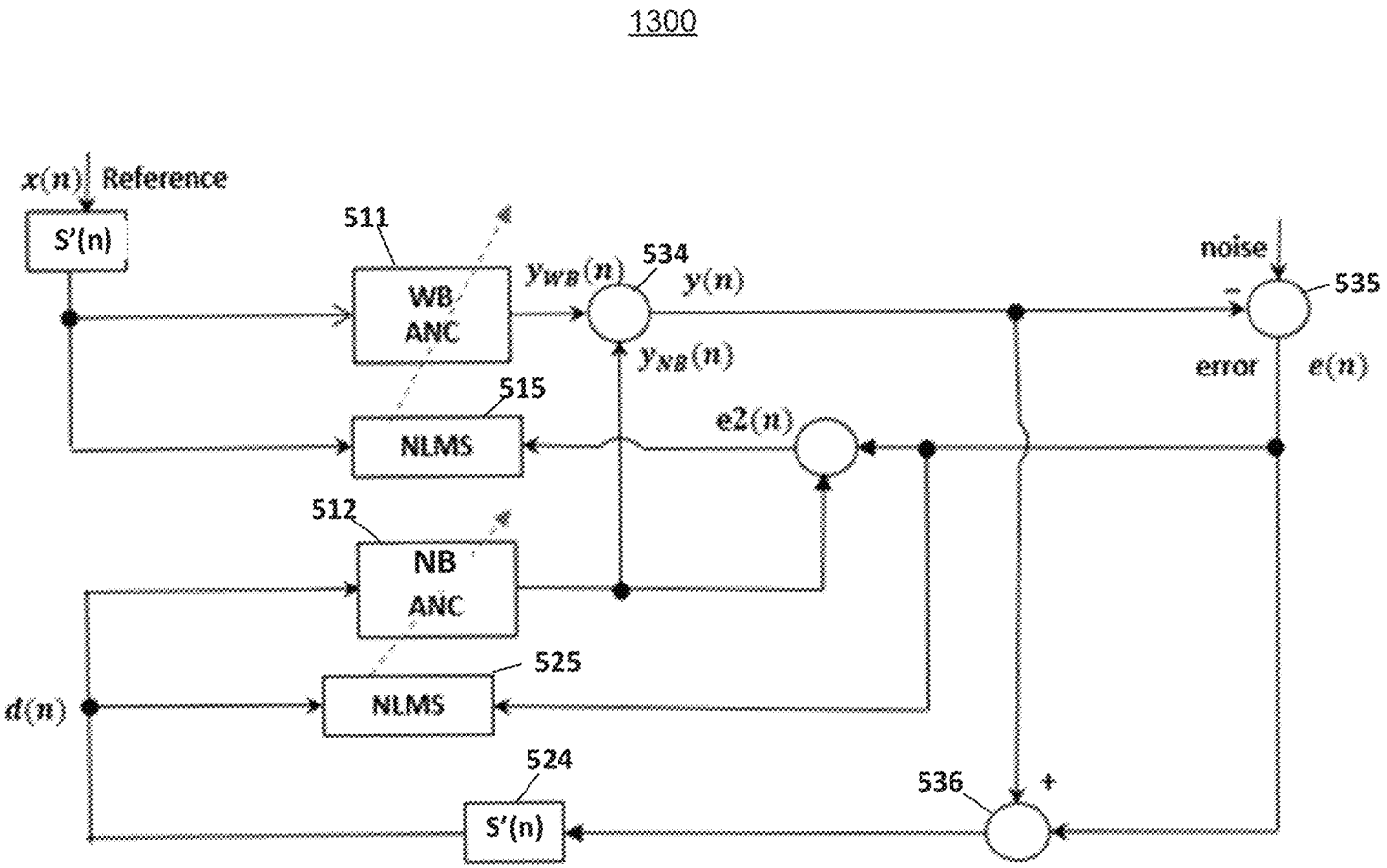
FIG. 13 is a simplified block diagram of an adaptive hybrid noise cancellation system similar to that of FIG. 9 with a combined modeled secondary path for both the WB ANC unit and the NB ANC unit according to still another embodiment of the present disclosure.

From FIG. 13, we see that:

$$e2(n)=e(n)+y_{NB}(n) \quad (29)$$

So that $$WB(n,k)=WB(n,k)+2*\mu1(n)*e2(n)*x'(n-k) \quad (30)$$

Embodiments of the present invention provide ANC technical solutions that can adapt to user experience and user specifications and be able to fully utilize technological advances in hardware and software. Thus, the noise reduction requirements can adapt to different devices with different specifications and frequencies. Analog ANC solutions only cancel noise up to a certain degree for frequencies in the range from 50 to 500 Hz, which is acceptable for most users. With the availability of digital ANC solution, users can expect noise attenuation across a large frequency range.

For example, according to some embodiments, performance requirements have the following specifications: average noise attenuation around 30 dB for frequency range from 50 Hz to 500 Hz, around 20 dB for frequencies from 500 Hz to 1000 Hz, 10 dB for frequencies from 1000 Hz to 2000 Hz, 5 dB for frequency range from 2000 Hz to 3000 Hz, and 0 dB for frequency range from 3000 Hz to 4000 Hz, four equalizers (EQ) corresponding to four frequency ranges or bands are to be designed to adaptively attenuate or cancel noise according to the frequency bands. The well-known waterbed-type effect with ANC requires more noise attenuation in certain frequency bands while noise amplification in some other frequency bands, an equalizer design needs to balance a trade-off between the attenuation and amplification in different frequency bands.

Equalizers are commonly used to compensate for the loss of signals in different frequency bands. There is more noise in certain frequency bands, and in some other frequency bands, noise is attenuated by the device itself and by the device noise blocking feature. Therefore, noise reduction may be required in certain frequency bands having more noise than in other frequency bands having less noise if there is no equalizer used because the nature of adaptive filtering algorithms. Equalizers should have several individual equalizers (for example, biquads) to handle the issues due to the device acoustics.

Equalizers have an inherent drawback of phase distortion that may cause signal delays in high-speed system applications, and therefore, equalizers are not suitable in the high-speed hybrid adaptive noise cancellation systems as shown in FIGS. 2, 3, and 4. This is because equalizers not only change the amplitude frequency response, but also the phase response, which may negatively affect ANC performance. For example, equalizers increase delays in the equalization path causing performance degradation. In accordance with the present disclosure, the active noise control filters for the reference noise, error noise, feedback noise are trained at low sampling rates, equalizers can be used without the negative effect of phase distortion.

Equalizer specifications for the WB ANC filter may be different from the NB ANC filter. For example, if the WB ANC filter cancels noise well in a frequency band, the NB ANC filter may amplify noise in that frequency band if there is no equalizer for the NB ANC filter to handle the changed noise response with the WB ANC filter.

Figure 14:
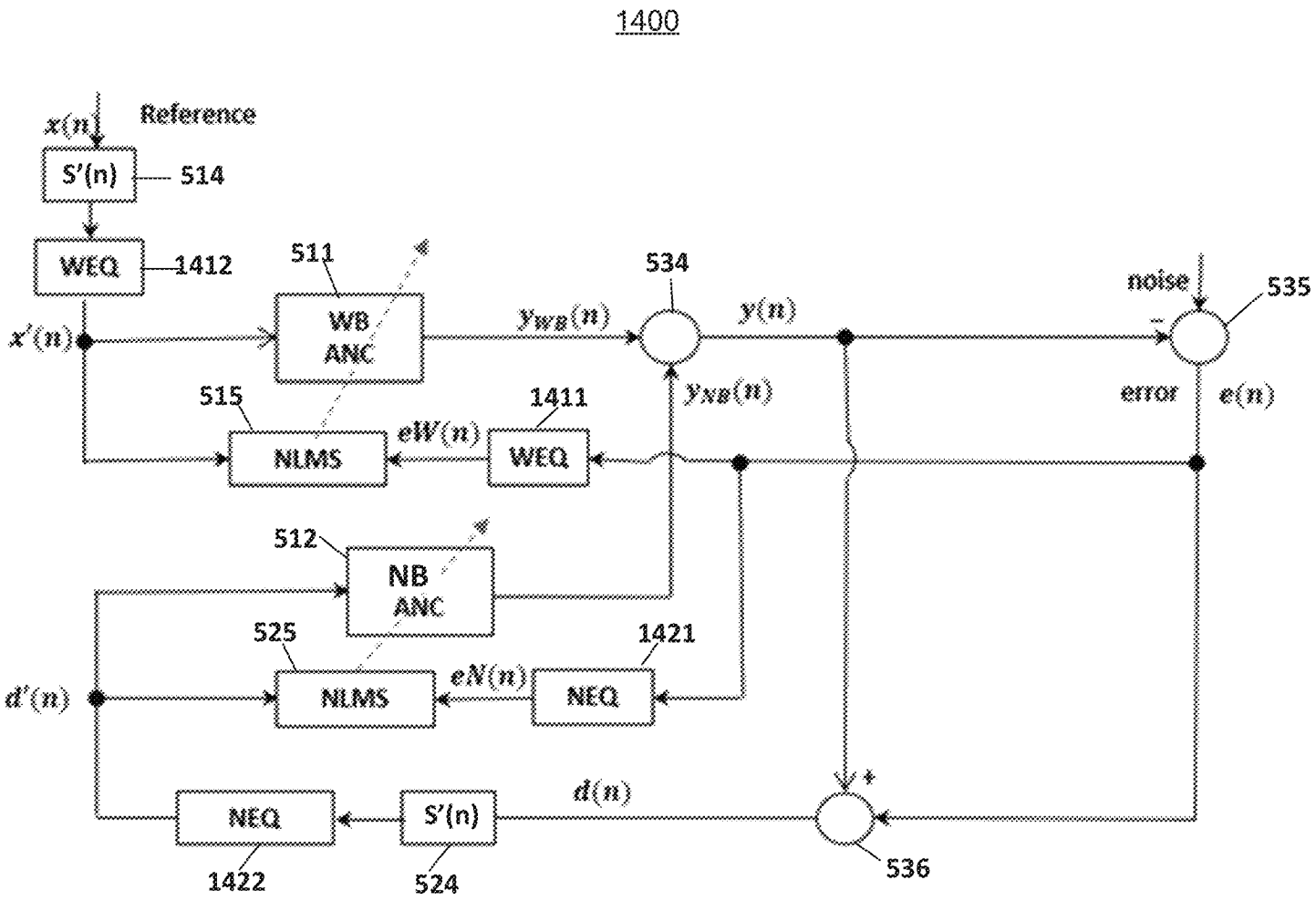
FIG. 14 is a simplified block diagram of an adaptive hybrid noise cancellation system including a wideband equalizer for the WB ANC filter and a narrowband equalizer for the NB ANC filter according to an embodiment of the present disclosure.

FIG. 14 is a simplified block diagram of an adaptive hybrid noise cancellation system 1400 including wideband equalizers WEQs for the WB ANC filter and narrowband equalizers NEQs for the NB ANC filter according to an embodiment of the present disclosure. Adaptive hybrid noise cancellation system 1400 includes a first WEQ 1411 disposed between the first NLMS filter 515 and the output of the second adder 535, a second WEQ 1412 disposed between the output of the first modeled feedback filter S'(n) 514 and an input of the WB ANC filter 511. Adaptive hybrid noise cancellation system 1400 also includes a first NEQ 1421 disposed between the output of the second adder 535 and the second NLMS filter 525, and a second NEQ 1422 disposed between the output of the second modeled feedback filter S'(n) 524 and an input of the NB ANC filter 512.

From FIG. 14, we see that $$x'(n)=x(n)\otimes S'(n)\otimes WEQ(n) \quad (31)$$

$$d'(n)=d(n)\otimes S'(n)\otimes NEQ(n) \quad (32)$$

$$y(n)=y_{WB}(n)+y_{NB}(n) \quad (33)$$

In which WEQ(n) is a wideband equalizer response, NEQ(n) is a narrowband equalizer response, and $y_{WB}$ (n) is the output of the adaptive WB ANC filter and equals to $$y_{WB}(n)=x'(n)\otimes WB(n) \quad (34)$$

WB(n) is the adaptive filter response of the WB ANC filter and the operator $\otimes$ is the convolution. Similarly, $y_{NB}$(n) is the output of the NB ANC filter and equals to $$y_{NB}(n)=d'(n)\otimes NB(n) \quad (35)$$

Where d(n) is the noise in the inner ear area and NB(n) is the adaptive filter response of the NB ANC filter. The error signal is $$e(n)=d(n)-y(n) \quad (36)$$

Since d(n) is not directly available, it is estimated from $$d(n)=e(n)+y(n) \quad (37)$$

According to a normalized least mean square (NLMS) algorithm, the WB and NB ANC filters are updated according to $$WB(n,k)=WB(n,k)+2*\mu1(n)*eW(n)*x'(n-k) \quad (38)$$

Where μ1(n) is a normalized adaptation coefficient and $$eW(n)=e(n)\otimes WEQ(n) \quad (39)$$

$$NB(n,k)=NB(n,k)+2*\mu2(n)*eN(n)*d'(n-k) \quad (40)$$

Where μ2(n) is a normalized adaptation coefficient and $$eN(n)=e(n)\otimes NEQ(n) \quad (41)$$

$$d'(n)=d(n)\otimes S'(n)\otimes NEQ(n) \quad (42)$$

The above mathematic operations can be realized via both hardware and software. Software implementation is preferred because of its flexibility that enables easy and quick replacement of existing algorithms with other adaptive algorithms.

Figure 15:
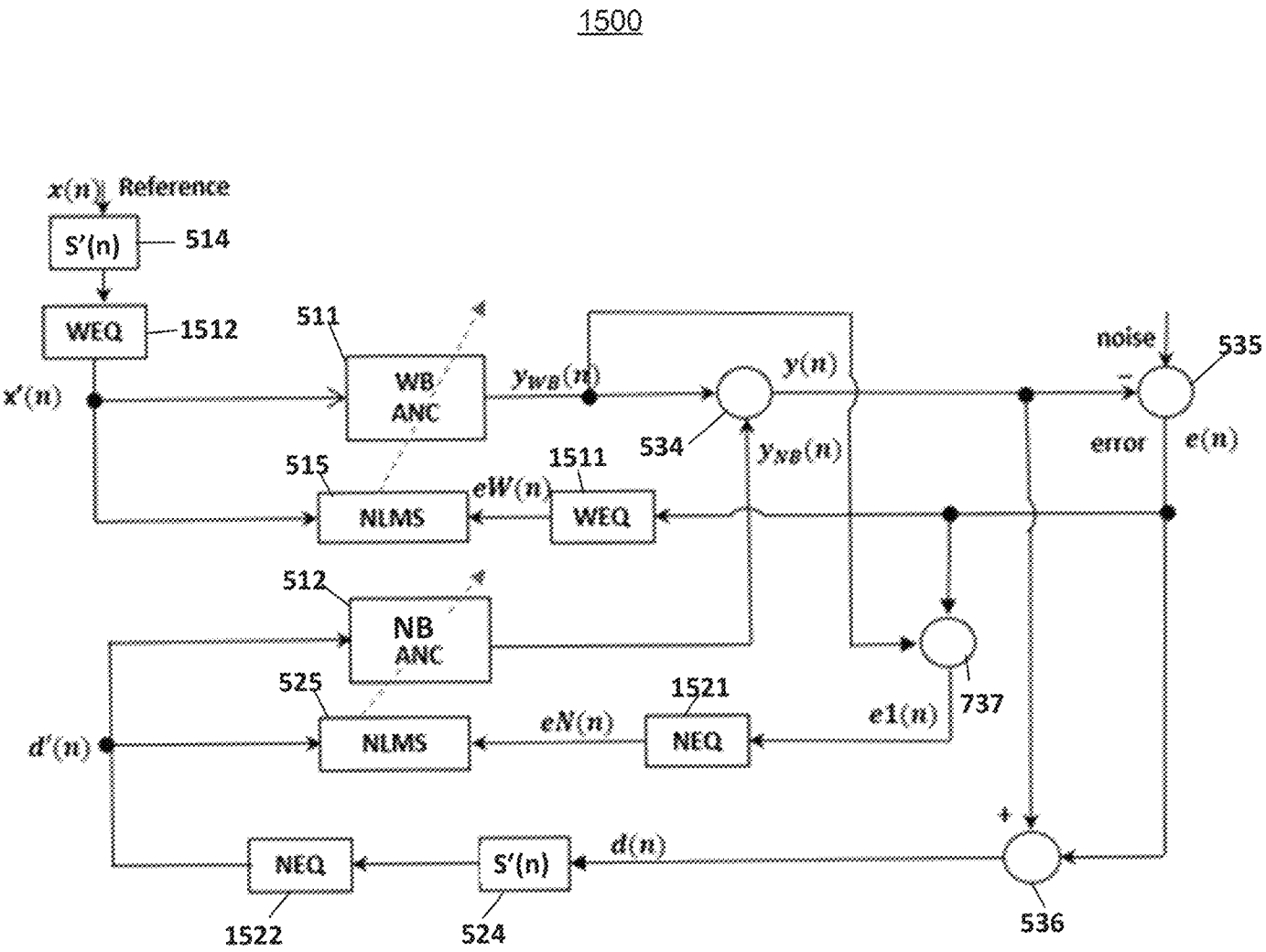
FIG. 15 is a simplified block diagram of an adaptive hybrid noise cancellation system including a wideband equalizer for the WB ANC filter and a narrowband equalizer for the NB ANC filter according to another embodiment of the present disclosure.

FIG. 15 is a simplified block diagram of an adaptive hybrid noise cancellation system 1500 including wideband equalizers WEQs for the WB ANC filter and narrowband equalizer NEQs for the NB ANC filter according to another embodiment of the present disclosure. Adaptive hybrid noise cancellation system 1500 includes a first WEQ 1511 disposed between the first NLMS filter 515 and the output of the second adder 535, a second WEQ 1512 disposed between the output of the first modeled feedback filter S'(n) 514 and an input of the WB ANC filter 511. Adaptive hybrid noise cancellation system 1500 also includes a first NEQ 1521 disposed between the output of an adder 737 and the second NLMS filter 525, and a second NEQ 1522 disposed between the output of the second modeled feedback filter S'(n) 524 and an input of the NB ANC filter 512. In one embodiment, adder 737 provides an error signal e1(n) from the error signal e(n) of the second adder 535 and the wideband anti-noise signal $y_{WB}(n)$ of the WB ANC filter 511.

From FIG. 15, we see that:

$$e1(n)=e(n)+y_{WB}(n) \tag{43}$$

So that $$NB(n,k)=NB(n,k)+2*\mu2(n)*eN(n)*d'(n-k) \tag{44}$$

Figure 16:
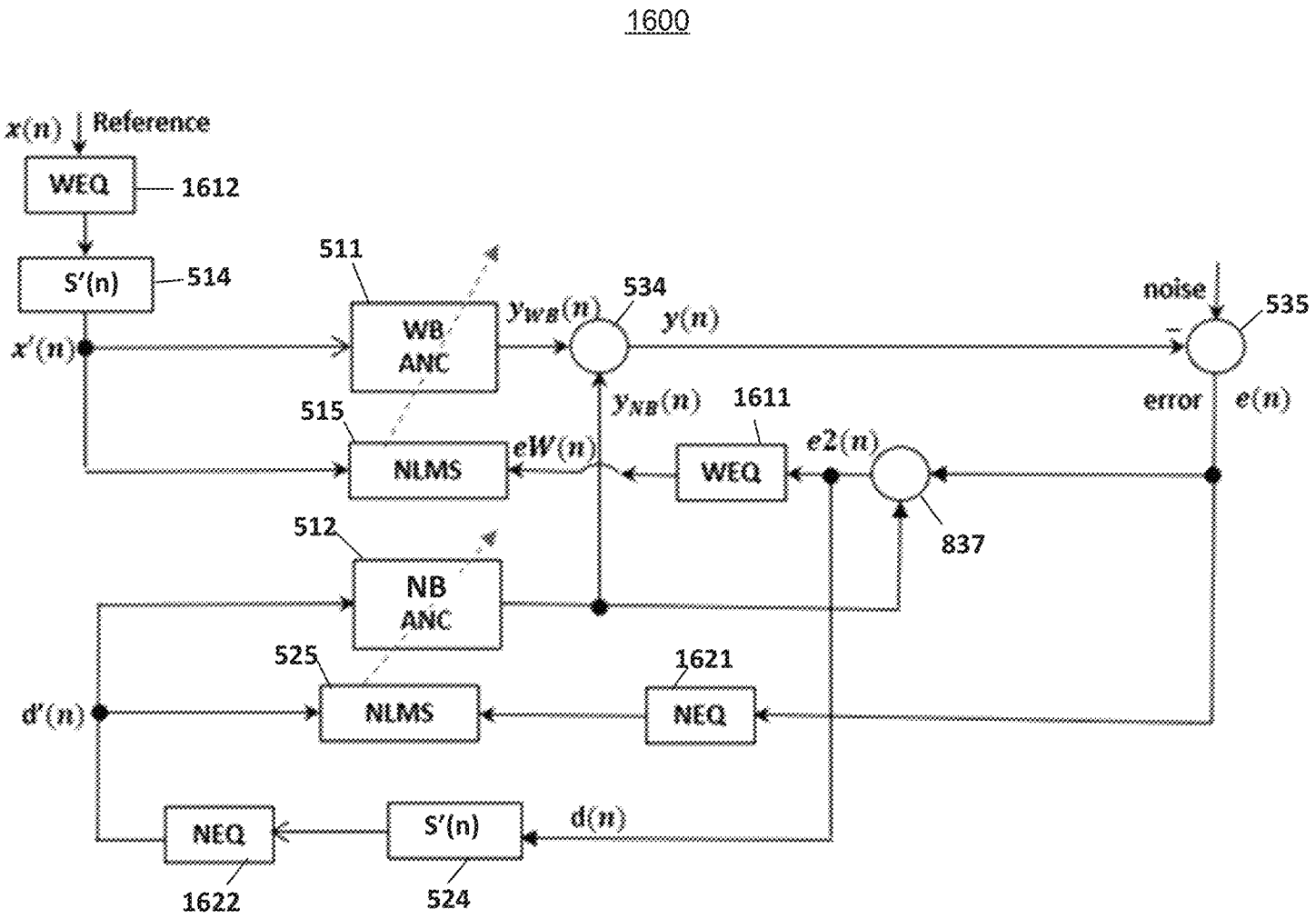
FIG. 16 is a simplified block diagram of an adaptive hybrid noise cancellation system including a wideband equalizer for the WB ANC filter and a narrowband equalizer for the NB ANC filter according to yet another embodiment of the present disclosure.

FIG. 16 is a simplified block diagram of an adaptive hybrid noise cancellation system 1600 including a wideband equalizer for the WB ANC filter and a narrowband equalizer for the NB ANC filter according to yet another embodiment of the present disclosure. Adaptive hybrid noise cancellation system 1600 includes an adder 837 configured to receive an error signal e(n) of a second adder (535) and an NB anti-noise signal $y_{NB}(n)$ of the NB ANC filter 512 and provide an output signal e2(n), a first WEQ 1611 disposed between the first NLMS filter 515 and the output of the adder 837, a second WEQ 1612 disposed in front of the first modeled feedback filter S'(n) 514 and configured to equalize the reference signal. Adaptive hybrid noise cancellation system 1600 also includes a first NEQ 1621 disposed between the output of the second adder 535 and the second NLMS filter 525, and a second NEQ 1522 disposed between the output of the second modeled feedback filter S'(n) 524 and an input of the NB ANC filter 512.

From FIG. 16, we see that:

$$e2(n)=e(n)+y_{NB}(n) \tag{45}$$

So that $$WB(n,k)=WB(n,k)+2*\mu1(n)*eW(n)*x'(n-k) \tag{46}$$

Where $$eW(n)=e2(n))\otimes WEQ(n) \tag{47}$$

$$NB(n,k)=NB(n,k)+2*\mu2(n)*eN(n)*d'(n-k) \tag{49}$$

Figure 17:
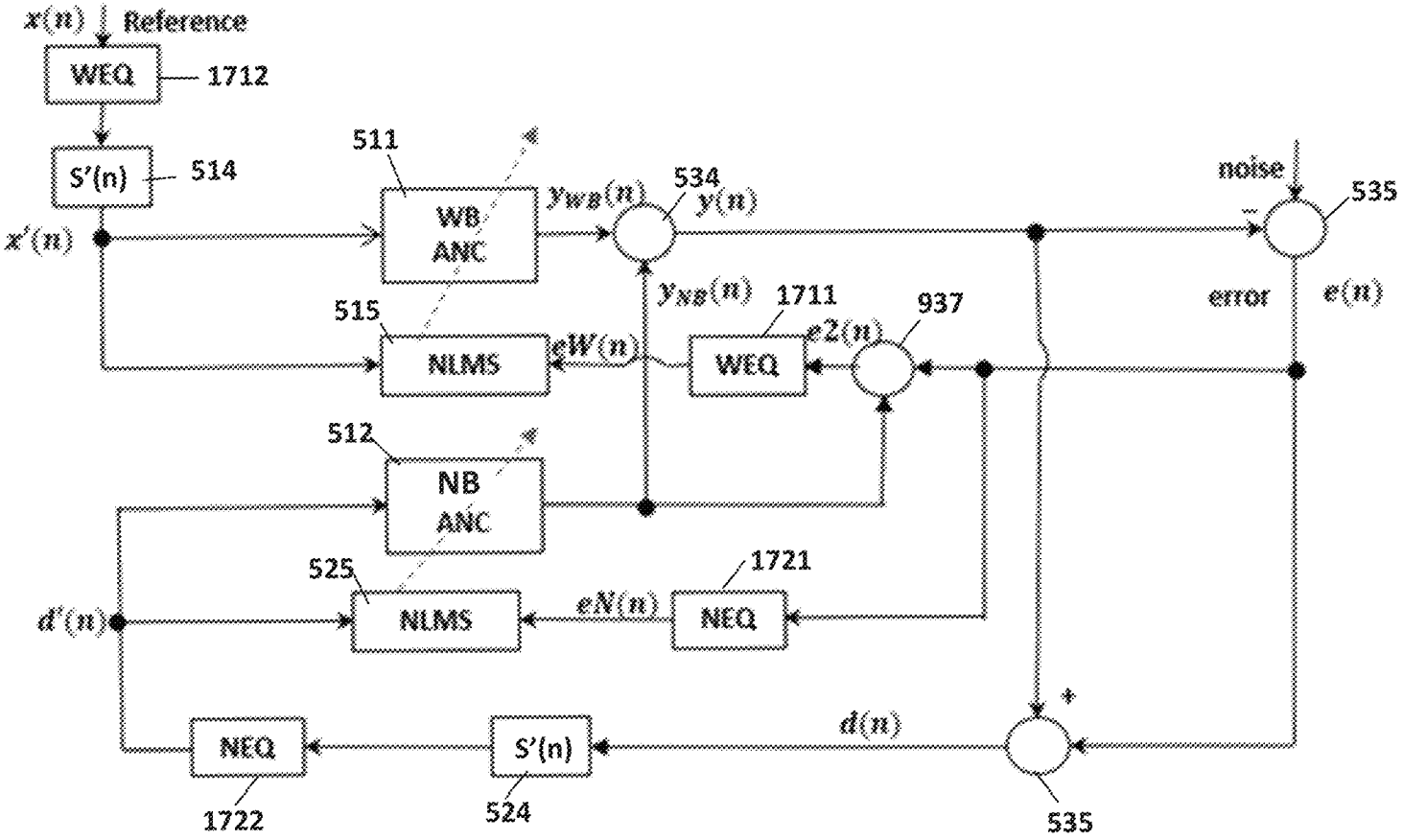
FIG. 17 is a simplified block diagram of an adaptive hybrid noise cancellation system including a wideband equalizer for the WB ANC filter and a narrowband equalizer for the NB ANC filter according to an embodiment of the present disclosure.

FIG. 17 is a simplified block diagram of an adaptive hybrid noise cancellation system 1700 including a wideband equalizer for the WB ANC filter and a narrowband equalizer for the NB ANC filter according to an embodiment of the present disclosure. Adaptive hybrid noise cancellation system 1700 includes an adder 937 configured to receive an error signal e(n) of second adder (535) and an NB anti-noise signal $y_{NB}(n)$ of the NB ANC filter 512 and provide an output signal e2(n), a first WEQ 1711 disposed between the first NLMS filter 515 and the output of the adder 937, a second WEQ 1712 disposed in front of the first modeled feedback filter S'(n) 514 and configured to equalize the reference signal. Adaptive hybrid noise cancellation system 1700 also includes a first NEQ 1721 disposed between the output of the second adder 535 and the second NLMS filter 525, and a second NEQ 1522 disposed between the output of the second modeled feedback filter S'(n) 524 and an input of the NB ANC filter 512.

From FIG. 17, we see that:

$$e2(n)=e(n)+y_{NB}(n) \tag{50}$$

So that $$WB(n,k)=WB(n,k)+2*\mu1(n)*eW(n)*x'(n-k) \tag{51}$$

Figure 18:
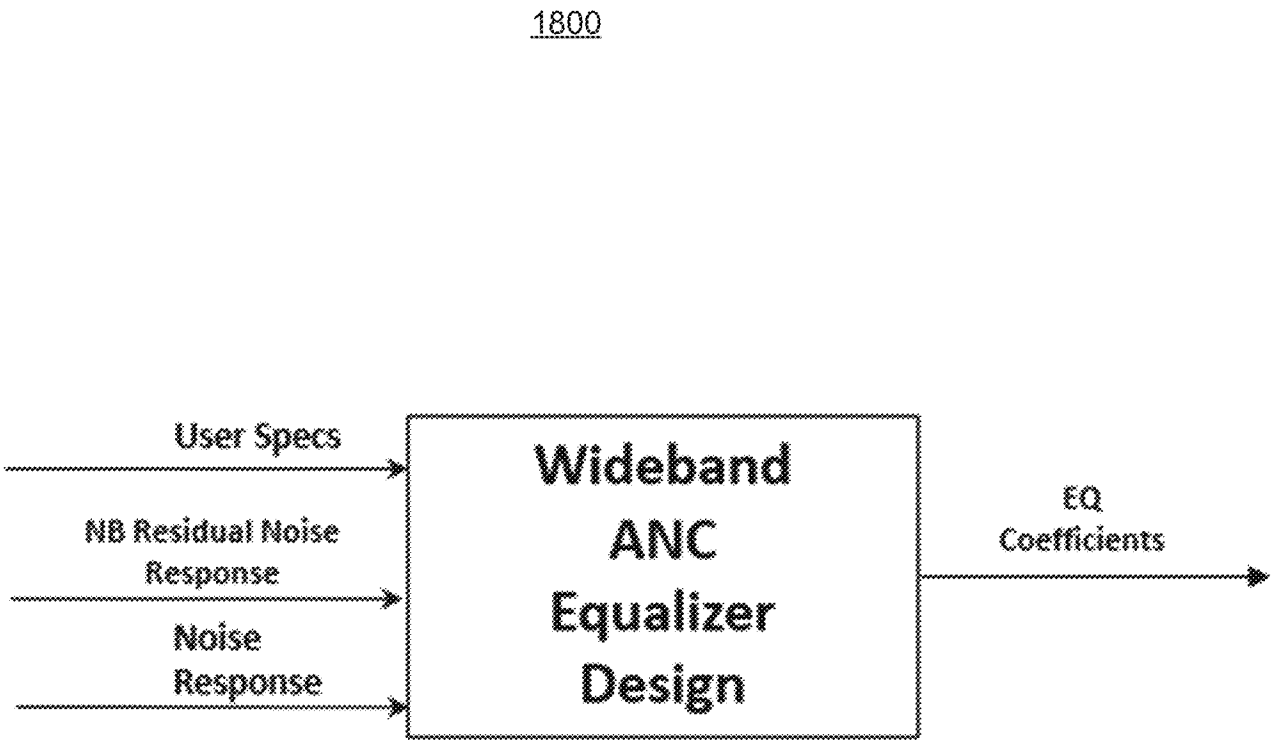
FIG. 18 is a block diagram of a wideband ANC equalizer according to an embodiment of the present disclosure.

FIG. 18 is a simplified block diagram of a WB ANC equalizer design according to an embodiment of the present disclosure. It uses user specifications, NB residual noise response and residual noise frequency response as inputs. Its output is a set of filter coefficients that will be converted to higher sampling rate for updating the WB ANC filter 211 in FIGS. 2 to 4. In one embodiment, the WB ANC filter include one or more sets of second order IIR filters (biquad).

According to the noise attenuation specifications, the equalizer can be designed accordingly. For example, four sets of biquad filters corresponding to four bands: 50 to 500 Hz (Band 1), 500 to 1000 Hz (Band 2), 1000 to 2000 Hz (Band 3), 2000 to 3000 Hz (Band 4), and 3000 to 4000 Hz, can be designed in which the amplitudes and Q factors can be specified so that amplitude frequency response Band 1 is higher than Band 2 by TH1 dB (for example 20 dB), amplitude response in Band 2 is higher than Band 3 by TH2 dB (for example, 10 dB), and amplitude response in Band 3 is higher than Band 4 by TH3 dB (for example, 5 dB). The thresholds can be determined both offline and online.

Additional biquad filters need to be designed according to noise response in which there are peaks and dips in some very narrow frequency bands. The additional biquad filters make sure the bands are handled, for example flatting the response.

Like the noise response, the noise reference response may also have peaks and dips mainly due to the secondary path response. The additional biquad filters make sure the frequency bands are handled, for example flatting the response.

Equalizer designs for both feedback and feedforward ANCs are related. For example, if the hybrid ANC design is to design feedback ANC filter first, the equalizers for feedforward ANC design must consider the noise cancelled by feedback ANC. If the attenuation is not considered, the second ANC design will converge slower in the frequency ranges where noise is attenuated or even amplified by WB ANC. Additional biquad filters are needed to boost significant noise reduced bands.

Figure 19:
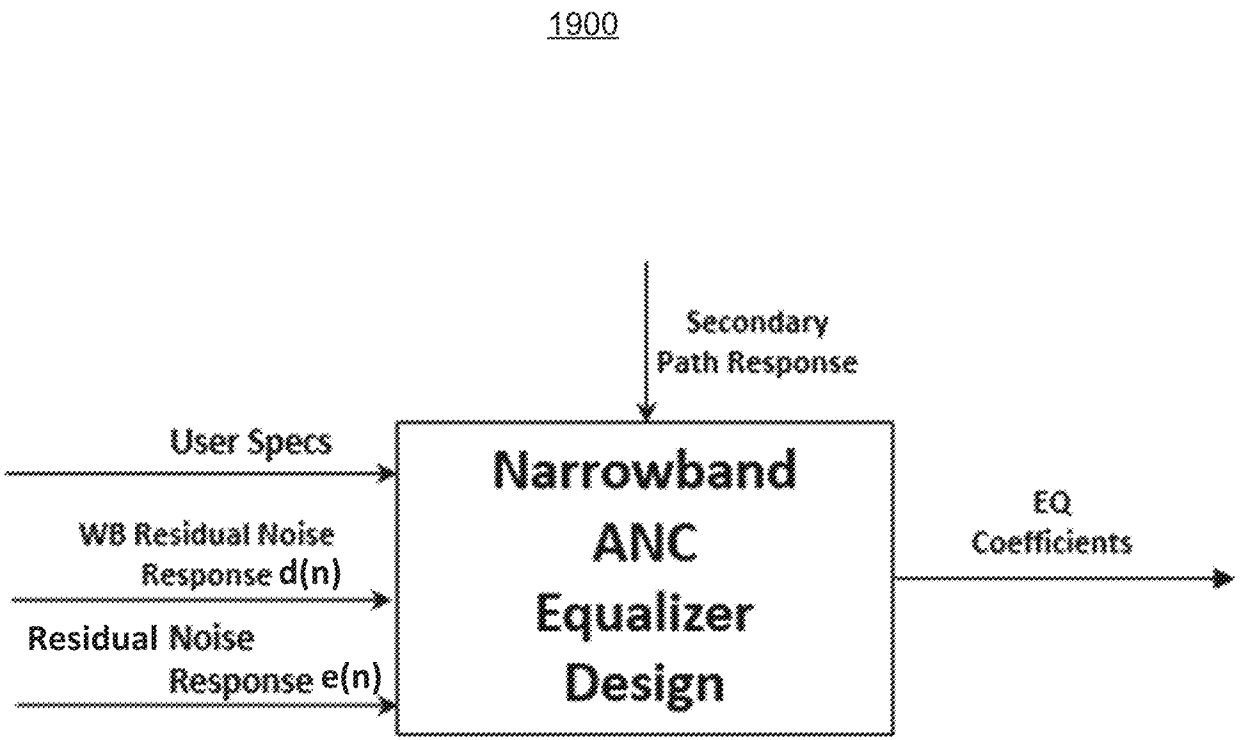
FIG. 19 is a block diagram of a narrowband ANC equalizer according to an embodiment of the present disclosure.

FIG. 19 is a simplified block diagram of an NB ANC equalizer design 1900 according to an embodiment of the present disclosure. The NB ANC training EQ design 1900 includes interfaces configured to receive user specifications, the WB residual noise response d(n), the residual noise response e(n), the secondary path response, and outputs a set of EQ coefficients that will be converted to higher sampling rate for updating the NB ANC filter 212 in FIGS. 2 to 4. In one embodiment, the NB ANC filter 212 in FIGS. 2 to 4 includes one or more sets of second order IIR filters (biquad).

According to the noise attenuation specifications, the equalizer can be designed accordingly. For example, four sets of biquad filters corresponding to four bands: 50 to 500 Hz (Band 1), 500 to 1000 Hz (Band 2), 1000 to 2000 Hz (Band 3), 2000 to 3000 Hz (Band 4), and 3000 to 4000 Hz, can be designed in which the amplitudes and Q factors can be specified so that amplitude frequency response in Band 1 is higher than Band 2 by TH1 dB (for example 30 dB), amplitude response in Band 2 is higher than Band 3 by TH2 dB (for example, 0 dB), and amplitude response in Band 3 is higher than Band 4 by TH3 dB (for example, 0 dB). The thresholds can be determined both offline and online. Note that NB ANC EQ specification can be very different from the one for WB ANC EQ. It just focuses on very low frequency band (50 to 500 Hz) because the working principle of NB ANC is based on prediction which requires signals to be narrowband or tonal-like.

Additional biquad filters need to be designed according to noise response in which there are peaks and dips in some very narrow frequency bands. The additional biquad filters make sure the bands are handled, for example flatting the response.

Like the noise response, the noise reference response may also have peaks and dips mainly due to secondary path response. The additional biquad filters make sure the bands are handled, for example flattening the frequency response.

Equalizer designs for both feedback and feedforward ANCs are related. For example, if the hybrid ANC design is to design WB ANC filter first, the equalizers for NB ANC design must consider the noise cancelled by WB ANC. If the attenuation is not considered, the second ANC design will converge slower in the frequency ranges where noise is attenuated or even amplified by NB ANC. Additional biquad filters are needed to boost significant noise reduced bands. It is noted that in the examples above, biquad filters are used as a realization of equalizers. However, one skilled in the art will appreciate that other filter types can also be used. The design of filters can be realized via using filter design algorithms. For example, peaking filters can be used for equalizers and their designs can be implemented in both real-time and offline.

Filter Rate Conversion of ANC Unit (FRCANCU)

In the prior art, an ANC filter is trained offline, or only gains are trained online, or the coefficients in a low-sampling rate are converted into the PDM domain via sigma-delta converter. If the ANC filter is trained offline, it may not handle device and environmental differences. If only the gain is trained, the performance improvement is limited and noise attenuation in one frequency band may result in noise amplification in other frequency bands. PCM coefficients converting to PDM coefficients via a sigma-delta converter may result in one-bit operations running at high speed and having long conversion time causing high hardware cost and increase delay in the anti-noise path resulting in performance much lower than expected in the training unit.

Although filters for high-speed ANC can be any types, IIR filters are preferred because only a few biquad filter are needed so that the cost of hardware and filtering operations are small. In the training unit, both IIR and FIR filters may be used.

Figure 20:
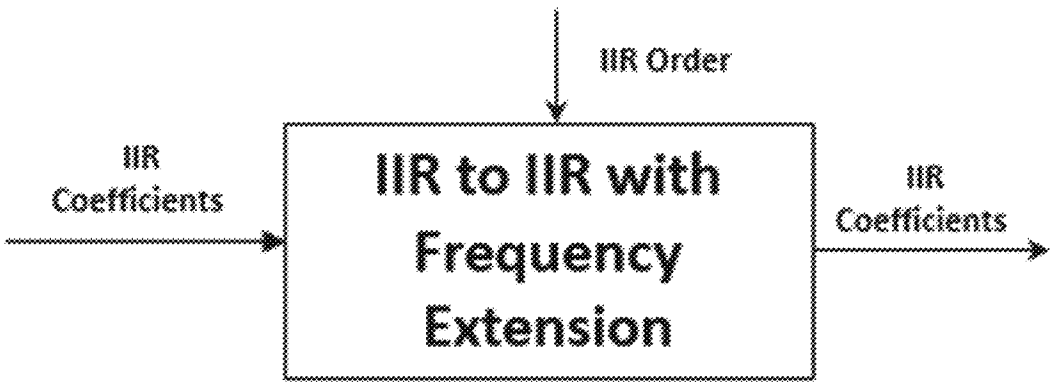
FIG. 20 is a block diagram of IIR to IIR filter with frequency extension according to an embodiment of the present disclosure.

FIG. 20 shows a block diagram of an adaptive hybrid noise cancellation system 2000 in which IIR filters are used as a set of biquad filters in the training block. The set of biquad filters is converted to another set of biquad filters but with an extended frequency range to the sampling rate of the high-speed unit. The frequency response in the converted set of filters is substantially similar or the same as the set of trained filters for the bandwidth of trained filter and the frequency response in the extended frequency range is kept as small as possible.

Let H1(w) be the frequency response of an IIR filter trained from the training unit (e.g., AHANCTU 142) with a sampling rate fs and H2(w) be the frequency response of being designed IIR filter with a sampling rate N times of fs where N>1. The order of IIR filter H2 may be the same as the order of the original IIR filter. The order can also be larger than the original IIR filter order.

$$e=\|H_2(w)-H_1(w)W(w)\|^2$$

So, the frequency response H2(w) is designed such that the error e is minimized. W(w) is a weighted filter. For example, W(w) has a non-zero value, e.g., one (unity), in the frequency range from 0 to fs and zero for the frequency range from fs to N*fs.

Another realization is to up-sampling original filter coefficients by N times and choose several poles and zeroes with a proper gain such that the IIR filter with chosen poles and zeros has a frequency response closer to the original IIR filter frequency response up to the sampling frequency fs. In this way, the frequency response of the resulted filter is small for frequency above fs, an important requirement for the rate conversion. In one embodiment, the filter coefficients of the WB ANC filter and the NB ANC filters are up-sampled with an up-sampling rate significantly equal to the down-sampling rate (decimation factor). For example, if the decimator factor is 16, the up-sampling rate is also 16. The up-sampled filter coefficients for the WB ANC and NB ANC filters in the HAANCU are chosen to produce magnitude and phase responses that closely match the magnitude and phase responses of the WB ANC and NB ANC filters in the AHANCTU.

Figure 21:
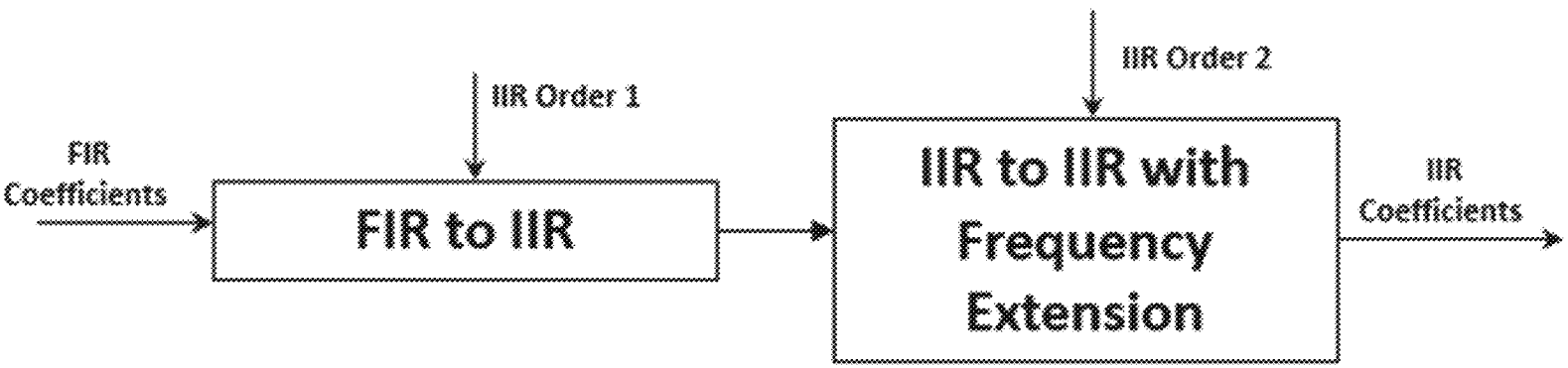
FIG. 21 is a block diagram of FIR to IIR filter with frequency extension according to an embodiment of the present disclosure.

FIG. 21 is a simplified block diagram of a FIR to IIR conversion with frequency extension 2100, in which FIR filters may be used in the training unit according to an embodiment of the present disclosure. The first step is to convert the WB ANC training EQ design to a set of biquad filters with substantially similar or the same frequency response in the focused frequency range of the ANC filters. Then the second step is to convert FIR filters to a set of biquad filters to another set of biquad filters with substantially similar or the same frequency responses in the frequency range that ANC focuses. The second step is to convert the set of biquad filters to another set of biquad filters but with an extended frequency range to the sampling rate of the high-speed unit as shown in FIG. 21.

There are many known papers on the order reduction and FIR to IIR conversion. One is based on Hankel Norm theory and control theory. Using Hankel Norm, one can find singular values of FIR filter, using control theory, one can build state space equation of an IIR filter-based system, and using Lyapunov equations, one can find IIR filter coefficients.

FIGS. 20 and 21 show realization of filter conversion from a low-sampling version to a high-sampling version. The low-sampling rate ANC filters have frequency range that ANC wants to cancel noise in that range. The high-sampling ANC filters have frequency range that is the same as the rate for high-speed unit where the frequency response is the same in the frequency band of both filters and frequency response is small in the high-speed ANC filters for the frequency above low-sampling rate filter frequencies.

Figure 22:
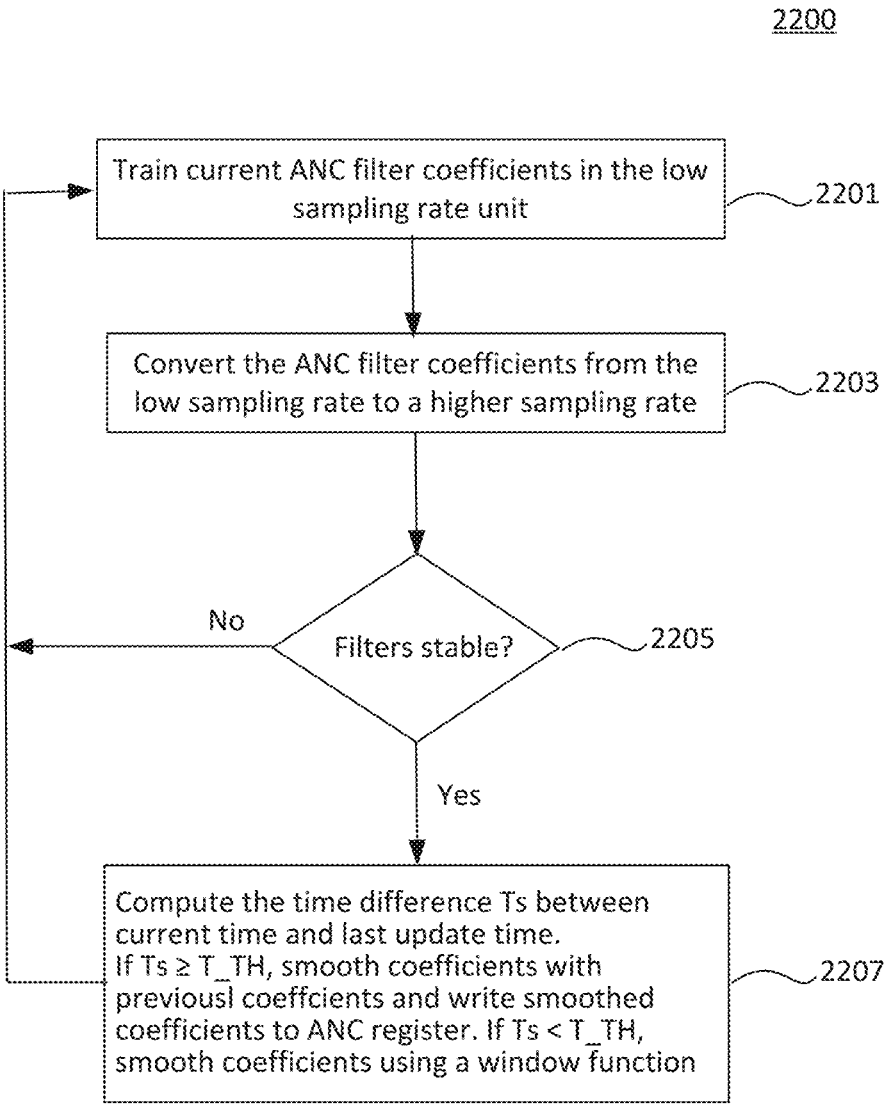
FIG. 22 is a FIG. 22 is a simplified flowchart illustrating an ANC filter update process 2200 of the hybrid active ANC unit according to an embodiment of the present disclosure.

FIG. 22 is a simplified flowchart illustrating an ANC filter update process 2200 of the hybrid active ANC unit according to an embodiment of the present disclosure. The steps shown in FIG. 22 will be described in detail below with reference to FIG. 1C. First, ANC filters are obtained via the ANC filter training unit (AHANCTU) 142 and ANC filter conversion unit 143, the obtained ANC filters can be used by the HAANCU 141 to perform noise reduction. In one exemplary embodiment, the HAANCU 141 has registers that contain ANC filter coefficients and the registers are updated via writing the trained and converted filter coefficients to the registers (e.g., in the block Update ANC filters 144). Since training and conversion of filters can be very quick, e.g., within a sampling interval of a low-sampling rate, writing the ANC filter coefficients to the registers can be as complete within the sampling interval of the low-sampling rate. That is, writing the ANC filter coefficients can be done directly without modifications. Thus, update ANC filter coefficients in the registers can be done with a slow sampling rate as long as there is no noticeable side effects. For example, update can be done in 1 ms, 5 ms, or even 100 ms.

Referring to FIG. 22, at step 2201, the ANC filter coefficients are trained in the AHANCTU 142 according to the decimated reference signal x(n) and the error signal e(n) and/or based on user provided ANC specifications at a low-sampling rate. The trained filter coefficients are converted to a higher sampling rate by using the ANC filter conversion unit 143, and the up-converted filter coefficients are written to the registers of the HAANCU 141 at step 2203. In one embodiment, the conversion includes an interpolator configured to interpolate the filter coefficients according to a conversion rate, and a sampling rate converter configured to perform interpolation filtering of the filter coefficients provided by the interpolator. At step 2205, the ANC filter update process 2200 determines whether the updated ANC filters are stable. In the event that the updated ANC filters are not stable (no at step 2205), the ANC filter training unit AHANCTU 142 repeats the ANC filter training at a slow-sampling rate at step 2201 and up-converting the obtained filter coefficients to a higher sampling rate for the HAANCU 141 for noise reduction until the filters are stable (yes at step 2205).

In one embodiment, the ANC filter update process 2200 further includes computing a time difference Ts between a current time and a last update time at step 2207. If the time difference Ts is greater than or equal to a predetermined time threshold T_TH, the ANC filter update process 2200 includes smoothing the current filter coefficients with previously filter coefficients at the last update. For example, smoothing the current filter coefficients with previously filter coefficients can be performed by averaging (e.g., summing and dividing the sum) the current filter coefficients with the previously filter coefficients. If the time difference Ts is less than the predetermined time threshold T_TH, the ANC filter update process 2200 includes smoothing the current filter coefficients with a window function.

In some embodiments, the predetermined time threshold T_TH is a variable parameter that can be set according to applications or user provided specifications. In other words, the predetermined time threshold T_TH is an application specific or user-specific parameter. For example, stable biquad filters may not be obtained due to training, filter conversion, and other factors. Another reason may be that the filter conversion is slow in order to save processing power.

Figure 23:
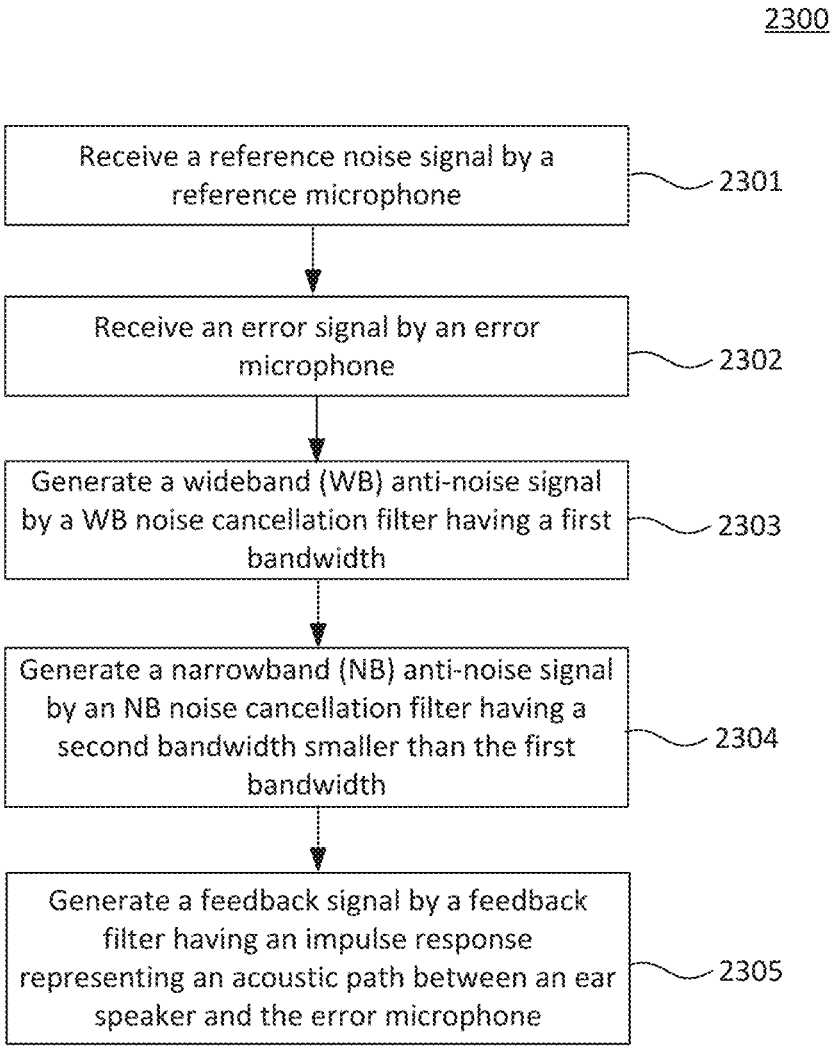
FIG. 23 is a simplified flowchart of an exemplary method for performing active noise cancellation according to some embodiments of the present disclosure.

FIG. 23 is a simplified flowchart of an exemplary method 2300 for performing active noise cancellation according to some embodiments of the present disclosure. According to some embodiments, the steps may be combined, performed in parallel, or performed in a different order. The method 2300 may also include addition or fewer steps than those shown in FIG. 23. In step 2301, a reference noise signal is received by a reference microphone, the received reference noise signal is then converted into a digital reference noise signal using, e.g., a first oversampling analog-digital converter, as shown in FIG. 1A. In step 2302, an error signal is received by an error microphone. The error signal is converted into a digital error signal by a second oversampling analog-digital converter, as shown in FIG. 1A. In one embodiment, the first and second oversampling analog-digital converters may be integrated in a single oversampling analog-digital converter integrated circuit. Alternatively, the reference noise signal and the error signal may be converted to digital data by a single analog-to-digital converter. In step 2303, a wideband (WB) anti-noise signal is generated by a WB noise cancellation filter having a first bandwidth from the digital reference noise signal. In step 2304, a narrowband (NB) anti-noise signal is generated from a noise signal by an NB noise cancellation filter having a second bandwidth that is smaller than the first bandwidth. In step 2305, a feedback signal is generated by a feedback filter having an impulse response representing an acoustic path between an ear speaker and the error microphone. In one embodiment, the feedback filter has an input connected to an input of the ear speaker for receiving a digital signal before it is converted to an analog signal by a DAC for outputting to the ear speaker, as shown in FIG. 1A. In some embodiments, the noise signal (e.g., d (n)) is generated by combining a modeled noise-reduced audio signal (e.g., ys'(n)) and the error signal, as shown in FIGS. 5, 6, 7, and 9.

Referring to FIGS. 1C and 5, an apparatus for hybrid active noise control (ANC) filter adaption includes a hybrid adaptive active noise control unit (HAANCU) configured to receive a first reference noise signal X(n) from a reference microphone and a first error signal E(n) from an error microphone and provide an anti-noise signal XE(n) to an ear speaker 171 for canceling the first reference noise signal and the first error signal, a decimator 164 and/or 165 configured to decimate the first reference noise signal and the first error signal to obtain a second reference noise signal x(n) and a second error signal e(n), an adaptive hybrid ANC training unit (AHANCTU) coupled to the decimator and comprising at least one noise cancellation filter 511, 512 and a feedback filter 513 configured to receive the second reference noise signal and the second error signal, train its coefficients to adapt to an acoustic path between the ear speaker and the error microphone, and provide a feedback signal ys(n) to the at least one noise cancellation filter to train parameters of the at least one noise cancellation filter, and rate conversion unit 143 coupled to the AHANCTU and configured to up-sample the parameters of the at least one noise cancellation filter and update the HAANCU with the up-sampled parameters.

In one embodiment, the AHANCTU includes a first adder 534 coupled to the WB ANC 511 and the NB ANC 512 and configured to provide a noise reduced audio signal y(n) from the WB anti-noise signal $y_{WB}(n)$, the NB anti-noise signal $y_{NB}(n)$, and an audio signal AI, a second adder 535 coupled to the feedback filter 513 and configured to provide the second error signal e(n) from a noise signal from ambient noise and the feedback signal, a first normalized least mean square (NLMS) filter 515 disposed between the second feedback filter 514 and the second adder 535 and configured to adapt (train) coefficients of the WB noise cancellation filter, and a second NLMS filter 525 disposed between the second feedback filter 524 and the second adder 535 and configured to adapt (train) coefficients of the NB noise cancellation filter.

The embodiments disclosed herein are not limited in scope by the specific embodiments described herein. Various modifications of the embodiments of the present invention, in addition to those described herein, will be apparent to those of ordinary skill in the art from the foregoing description and accompanying drawings. Further, although some of the embodiments of the present invention have been described in the context of a particular implementation in a particular environment for a particular purpose, those of ordinary skill in the art will recognize that its usefulness is not limited thereto and that the embodiments of the present invention can be beneficially implemented in any number of environments for any number of purposes.

What is claimed is:

1. An apparatus for hybrid active noise control (ANC) filter adaption, the apparatus comprising:

a secondary path filter representing a down-sampled modeling of an impulse response of an acoustic path between an audio transducer and an error microphone collocated in an inner ear area;

a wide-band (WB) active noise cancellation (ANC) filter to generate a WB anti-noise signal from a reference noise signal based on first filter coefficients, the reference noise signal representing audio input of a reference microphone located away from the inner ear area;

a first training filter to dynamically train the first filter coefficients based on a secondary-path-filtered reference noise signal and an error signal generated from audio information received by the error microphone, the secondary-path-filtered reference noise signal generated by filtering the reference noise signal using the secondary path filter;

a narrow-band (NB) ANC filter to generate a NB anti-noise signal from an estimated noise signal based on second filter coefficients, the estimated noise signal representing estimated noise in the inner ear area;

a second training filter to dynamically train the second filter coefficients based on a secondary-path-filtered estimated noise signal and the error signal, the secondary-path-filtered estimated noise signal generated by filtering the estimated noise signal using the secondary path filter.

2. The apparatus of claim 1, further comprising:

first logic to generate a summed sound signal that combines an audio input signal with the WB anti-noise signal and the NB anti-noise signal for output via the audio transducer.

3. The apparatus of claim 2, further comprising:

second logic to generate the error signal based on the summed sound signal and the audio information received by the error microphone.

4. The apparatus of claim 2, further comprising:

second logic to generate the estimated noise signal based on the summed sound signal and the error signal.

5. The apparatus of claim 2, further comprising:

second logic to generate a modified error signal having the audio input signal removed from the error signal, wherein the first training filter is to dynamically train the first filter coefficients based on the secondary-path-filtered reference noise signal and the modified error signal, and the second training filter is to dynamically train the second filter coefficients based on the secondary-path-filtered estimated noise signal and the modified error signal.

6. The apparatus of claim 1, further comprising:

logic to generate a modified error signal based on a combination of the error signal and the WB anti-noise signal, wherein the first training filter is to dynamically train the first filter coefficients based on the secondary-path-filtered reference noise signal and the error signal, and the second training filter is to dynamically train the second filter coefficients based on the secondary-path-filtered estimated noise signal and the modified error signal.

7. The apparatus of claim 1, further comprising:

logic to generate a modified error signal based on a combination of the error signal and the NB anti-noise signal, wherein the first training filter is to dynamically train the first filter coefficients based on the secondary-path-filtered reference noise signal and the modified error signal, and the second training filter is to dynamically train the second filter coefficients based on the secondary-path-filtered estimated noise signal and the error signal.

8. The apparatus of claim 1, wherein:

the WB ANC filter is to generate the WB anti-noise signal from the reference noise signal by using the secondary-path-filtered reference noise signal; and the NB ANC filter is to generate the NB anti-noise signal from the estimated noise signal by using the secondary-path-filtered estimated noise signal.

9. The apparatus of claim 1, further comprising:

a WB equalizer and a NB equalizer, wherein:

the WB ANC filter is to generate the WB anti-noise signal from the reference noise signal by using an equalized reference noise signal generated by passing the reference noise signal through the WB equalizer;

the first training filter is to dynamically train the first filter coefficients based on the equalized reference noise signal and a WB-equalized error signal generated by passing the error signal through the WB equalizer;

the NB ANC filter is to generate the NB anti-noise signal from the estimated noise signal by using an equalized estimated noise signal generated by passing the estimated noise signal through the NB equalizer; and the second training filter is to dynamically train the second filter coefficients based on the equalized estimated noise signal and a NB-equalized error signal generated by passing the error signal through the NB equalizer.

10. The apparatus of claim 1, wherein:

the first training filter comprises a first normalized least mean square (NLMS) filter; and the second training filter comprises a second NLMS filter.

11. The apparatus of claim 1, further comprising:

the audio transducer;

the error microphone; and the reference microphone.

12. A method for hybrid active noise control (ANC) filter adaption, the method comprising:

receiving a reference noise signal from a reference microphone located away from an inner ear area;

generating an error signal based on audio information received by an error microphone;

generating an estimated noise signal to represent estimated noise in the inner ear area;

generating a secondary-path-filtered reference noise signal and a secondary-path-filtered estimated noise signal by filtering the reference noise signal and the estimated noise signal, respectively, according to a down-sampled modeling of an impulse response of an acoustic path between an audio transducer and the error microphone collocated in the inner ear area;

training first filter coefficients dynamically based on the secondary-path-filtered reference noise signal and the error signal;

training second filter coefficients dynamically based on the secondary-path-filtered estimated noise signal and the error signal;

generating a wide-band (WB) anti-noise signal from the reference noise signal based on the first filter coefficients; and generating a narrow-band (NB) anti-noise signal from the estimated noise signal based on the second filter coefficients.

13. The method of claim 12, wherein:

the training the first filter coefficients and the training the second filter coefficients are performed independently and concurrently.

14. The method of claim 12, further comprising:

generating a summed sound signal that combines an audio input signal with the WB anti-noise signal and the NB anti-noise signal; and outputting the summed sound signal via the audio transducer.

15. The method of claim 14, further comprising:

generating the error signal based on the summed sound signal and the audio information received by the error microphone.

16. The method of claim 14, further comprising:

generating the estimated noise signal based on the summed sound signal and the error signal.

17. The method of claim 14, further comprising:

generating a modified error signal based on removing the audio input signal from the error signal, wherein the training the first filter coefficients is based on the secondary-path-filtered reference noise signal and the modified error signal, and the training the second filter coefficients is based on the secondary-path-filtered estimated noise signal and the modified error signal.

18. The method of claim 12, further comprising:

generating a modified error signal based on a combination of the error signal and the WB anti-noise signal, wherein the training the first filter coefficients is based on the secondary-path-filtered reference noise signal and the error signal, and the training the second filter coefficients is based on the secondary-path-filtered estimated noise signal and the modified error signal.

19. The method of claim 12, further comprising:

generating a modified error signal based on a combination of the error signal and the NB anti-noise signal, wherein the training the first filter coefficients is based on the secondary-path-filtered reference noise signal and the modified error signal, and the training the second filter coefficients is based on the secondary-path-filtered estimated noise signal and the error signal.

20. The method of claim 12, further comprising:

generating an equalized reference noise signal and a WB-equalized error signal by passing the reference noise signal and the error signal, respectively, through a WB equalizer; and generating an equalized estimated noise signal and a NB-equalized error signal by passing the estimated noise signal and the error signal, respectively, through a NB equalizer, wherein the generating the WB anti-noise signal is from the reference noise signal by using the equalized reference noise signal, the training the first filter coefficients is based on the equalized reference noise signal and the WB-equalized error signal, the generating the NB anti-noise signal is from the estimated noise signal by using the equalized estimated noise signal, and the training the second filter coefficients is based on the equalized estimated noise signal and the NB-equalized error signal.

* * * * *